US008196269B2

(12) United States Patent
Dais et al.

(10) Patent No.: US 8,196,269 B2
(45) Date of Patent: Jun. 12, 2012

(54) CLOSURE MECHANISM FOR A RECLOSEABLE POUCH

(75) Inventors: Brian C. Dais, Saginaw, MI (US); Robert R. Turvey, Sanford, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1126 days.

(21) Appl. No.: 12/047,446

(22) Filed: Mar. 13, 2008

(65) Prior Publication Data

US 2008/0307614 A1 Dec. 18, 2008

Related U.S. Application Data

(63) Continuation-in-part of application No. 11/818,585, filed on Jun. 15, 2007, now Pat. No. 7,857,515.

(51) Int. Cl.
*A44B 19/16* (2006.01)

(52) U.S. Cl. ..... 24/400; 24/399; 24/572.1; 383/63

(58) Field of Classification Search ..... 24/399, 24/400, 443, 585.12, 572.1, 585.1, 30.5 R, 24/DIG. 50, 584.1; 383/59, 98, 61.1, 61.2, 383/63, 203

See application file for complete search history.

(56) References Cited

U.S. PATENT DOCUMENTS

| | | | | | |
|---|---|---|---|---|---|
| 18,419 | A | * | 10/1857 | Watrous | 24/30.5 R |
| 2,772,712 | A | * | 12/1956 | Post | 383/65 |
| 3,173,184 | A | * | 3/1965 | Ausnit | 24/399 |
| 3,203,062 | A | * | 8/1965 | Ausnit | 24/400 |
| 3,557,413 | A | | 1/1971 | Engle | |
| 3,565,147 | A | | 2/1971 | Ausnit | |
| 4,020,884 | A | * | 5/1977 | Jadot | 383/63 |
| 4,363,345 | A | | 12/1982 | Scheibner | |
| 4,736,450 | A | | 4/1988 | Van Erden et al. | |
| 4,741,789 | A | | 5/1988 | Zieke et al. | |
| 4,755,248 | A | | 7/1988 | Geiger et al. | |
| 4,756,628 | A | | 7/1988 | Branson | |
| 4,787,754 | A | | 11/1988 | Herrington | |
| 4,787,880 | A | | 11/1988 | Ausnit | |
| 4,807,300 | A | | 2/1989 | Ausnit et al. | |
| 4,875,259 | A | | 10/1989 | Appeldorn | |

(Continued)

FOREIGN PATENT DOCUMENTS

JP 3294043 5/2002

(Continued)

*Primary Examiner* — Robert J Sandy
*Assistant Examiner* — Tyler Johnson

(57) ABSTRACT

A closure mechanism for a reclosable pouch includes a female profile having first, second, and third legs extending from a base of a first closure element. A first sealing flange is attached to each of the first and second legs, with a slit disposed through the first sealing flange to define a first sealing flap that depends from the first leg and a second sealing flap that depends from the second leg. A second sealing flange is attached to each of the second and third legs, with a slit disposed through the second sealing flange to define a third sealing flap that depends from the second leg and a fourth sealing flap that depends from the third leg. A first male profile extends from a base of a second closure element. The first male profile engages a portion of the first and second sealing flaps to form a seal therebetween when the respective male and female profiles are occluded. A second male profile extends from the base of the second closure element. The second male profile engages a portion of the third and fourth sealing flaps to form a seal therebetween when the respective male and female profiles are occluded.

13 Claims, 16 Drawing Sheets

U.S. PATENT DOCUMENTS 4,892,414 A * 1/1990 Ausnit ..... 383/63
4,927,474 A 5/1990 Pawloski
5,012,561 A 5/1991 Porchia et al.
5,017,021 A 5/1991 Simonsen et al.
5,067,822 A 11/1991 Wirth et al.
5,070,584 A 12/1991 Dais et al.
5,119,531 A 6/1992 Berger et al.
5,179,767 A 1/1993 Allan
5,212,855 A 5/1993 McGanty
5,216,787 A 6/1993 Custer et al.
5,238,306 A 8/1993 Heintz et al.
RE34,554 E * 3/1994 Ausnit ..... 383/63
5,293,672 A * 3/1994 Tominaga et al. ..... 24/585.1
RE34,929 E 5/1995 Kristen
5,417,495 A 5/1995 Branson
5,478,228 A 12/1995 Dais et al.
5,655,273 A 8/1997 Tomic et al.
5,689,866 A 11/1997 Kasai et al.
5,794,315 A * 8/1998 Crabtree et al. ..... 24/589.1
5,944,425 A 8/1999 Forman
6,021,557 A 2/2000 Dais et al.
6,138,329 A * 10/2000 Johnson ..... 24/584.1
6,167,597 B1 * 1/2001 Malin ..... 24/585.1
6,185,796 B1 2/2001 Ausnit
6,220,754 B1 * 4/2001 Stiglic et al. ..... 383/64
6,299,353 B1 10/2001 Piechocki et al.
6,371,644 B1 4/2002 Forman
6,691,383 B2 * 2/2004 Linton ..... 24/585.12
6,789,946 B2 * 9/2004 Plourde et al. ..... 383/63
6,854,886 B2 2/2005 Piechocki et al.
6,874,937 B2 * 4/2005 Ausnit ..... 383/64
6,954,969 B1 10/2005 Sprehe
7,041,249 B2 5/2006 Wright et al.
7,056,022 B2 * 6/2006 Linton et al. ..... 383/64
7,097,359 B2 * 8/2006 Plourde et al. ..... 383/63
7,137,736 B2 11/2006 Pawloski et al.
7,159,282 B2 * 1/2007 Blythe et al. ..... 24/400
7,290,660 B2 11/2007 Tilman et al.
7,305,742 B2 12/2007 Anderson
7,377,015 B2 * 5/2008 Long et al. ..... 24/399
7,410,298 B2 8/2008 Pawloski
7,527,585 B2 5/2009 Anzini et al.
7,665,192 B2 * 2/2010 Blythe et al. ..... 24/400
7,726,880 B2 6/2010 Zimmerman et al.
7,784,160 B2 * 8/2010 Dais et al. ..... 24/585.12
7,837,387 B2 11/2010 Newrones et al.
7,874,731 B2 1/2011 Turvey et al.
7,886,412 B2 2/2011 Dais et al.
7,887,238 B2 2/2011 Turvey et al.
7,904,996 B2 * 3/2011 Dobreski et al. ..... 24/400
7,946,766 B2 * 5/2011 Dais et al. ..... 383/59
7,967,509 B2 6/2011 Turvey et al.
8,096,329 B2 1/2012 Thuot et al.
2003/0217444 A1 * 11/2003 Blythe et al. ..... 24/399
2004/0091179 A1 5/2004 Anderson
2004/0111843 A1 * 6/2004 Savicki, Sr. ..... 24/399
2004/0161169 A1 * 8/2004 Fenzl et al. ..... 383/64
2004/0165794 A1 * 8/2004 Plourde et al. ..... 383/64
2004/0234172 A1 11/2004 Pawloski
2005/0025392 A1 * 2/2005 Stolmeier ..... 383/5
2005/0036719 A1 2/2005 Wu et al.
2005/0037163 A1 2/2005 Wu et al.
2005/0037164 A1 2/2005 Wu et al.
2005/0286808 A1 12/2005 Zimmerman et al.
2006/0048483 A1 3/2006 Tilman et al.
2006/0093242 A1 5/2006 Anzini et al.
2006/0111226 A1 5/2006 Anzini et al.
2006/0228057 A1 10/2006 Newrones et al.
2007/0101556 A1 * 5/2007 Blythe et al. ..... 24/400
2007/0116386 A1 * 5/2007 Sprague et al. ..... 383/64
2007/0154118 A1 7/2007 Tilman et al.
2007/0172157 A1 7/2007 Buchman
2008/0226202 A1 * 9/2008 Dais et al. ..... 383/63
2008/0226203 A1 * 9/2008 Dais et al. ..... 383/63
2008/0310771 A1 * 12/2008 Dais et al. ..... 383/59
2009/0175747 A1 7/2009 LeBoeuf et al.

FOREIGN PATENT DOCUMENTS

WO WO 2007/149656 12/2007

* cited by examiner

CLOSURE MECHANISM FOR A RECLOSEABLE POUCH

CROSS REFERENCE TO RELATED APPLICATIONS

This application is a continuation-in-part of U.S. patent application Ser. No. 11/818,585, filed Jun. 15, 2007, which issued as U.S. Pat. No. 7,857,515 on Dec. 28, 2010, and which is incorporated by reference herein in its entirety.

REFERENCE REGARDING FEDERALLY SPONSORED RESEARCH FOR DEVELOPMENT

Not applicable.

SEQUENTIAL LISTING

Not applicable.

BACKGROUND OF THE INVENTION

1. Field of the Invention

The disclosure relates generally to a closure mechanism for a reclosable pouch.

2. Description of the Background of the Invention

Thermoplastic pouch openings are frequently sealed using resealable closure assemblies. In addition, resealable closure mechanisms, having a single pair of opposing elongate interlocking profiles that are occluded between a user's fingers to create a seal, are known. Moreover, it is common to employ closure mechanisms having multiple pairs of elongate interlocking profiles when a stronger and more secure seal is desired.

Recently, efforts have been directed to developing improved closures for resealable packages. For example, one resealable closure mechanism has a first fastener profile that involves a first tape having a protrusion extending along the surface of the tape, and a second fastener profile that involves a second tape having a substantially C-shaped member extending along the surface of the tape. When the pouch is closed, front and back walls of the pouch are captured between the interlocked protrusion and C-shaped member.

Another closure assembly involves a slider-actuated closure mechanism in which a thin pliable membrane gets captured between first and second interlockable profiles of the closure mechanism. The membrane may be initially connected to the tops of the profiles across a mouth of the bag such that two layers of membrane material are captured between the closure mechanism profiles. Additionally, the membrane forms a tamper proof hermetic seal in an unopened package that requires the membrane to be sliced open to allow access to the inside of the package.

In another closure assembly, interlocking rib and groove elements act to reclosably seal a pouch opening. A funnel-shaped bag is connected to inner walls of the pouch just below the rib and groove elements and, when inverted, the funnel shaped bag may be disposed between the interlocking rib and groove elements.

An additional resealable closure assembly involves interlocking channels disposed along a pouch opening. A flexible strip extends along one side of the pouch up through the pouch and along the interlocking channels disposed on the side of the pouch. When the pouch is closed, the interlocking channels are pressed into each other with the flexible strip disposed between the interlocking channels.

In another closure assembly, a reclosable closure mechanism has a first profile and a second profile where the profiles have complementary bulbous members that interlock in a tight interference fit. The first profile is also provided with an asymmetrical arrow-shaped member that is interlockable with a groove element on the second profile.

In yet another closure assembly, a permanently closing plastic profile fastener has male and female profiles. The male profile is generally arrow-shaped and the female profile has a pair of side jaws that define a groove therebetween. The male profile is restrained from entering the female profile by a frangible diaphragm disposed across ends of the jaws of the female profile. The diaphragm blocks access into the female profile until a predetermined level of force is applied to push the profiles together, thereby fracturing the diaphragm and allowing the male profile to enter.

An additional closure assembly involves first and second mutually interlocking profiles having two sets of interlocking members. In addition, the central portion has at least one profile with a collapsible member. When the first and second mutually interlocking profiles are joined, the collapsible member compresses against the other profile to create a seal.

SUMMARY OF THE DISCLOSURE

In one aspect of the present disclosure, a closure mechanism for a reclosable pouch includes a first female profile having first and second legs extending from a first base of a first closure element, a first sealing flange attached to each of the first and second legs, and a slit disposed through the first sealing flange to define a first sealing flap that depends from the first leg and a second sealing flap that depends from the second leg. A first male profile extends from a second base of a second closure element. The first male profile is adapted to engage a portion of at least one of the first and second sealing flaps to form a seal therebetween when the first male and the first female profiles are occluded. Further, a surface of the second base is configured to engage at least one of the first and second sealing flaps to form a seal therebetween when the first male and the first female profiles are occluded.

In another aspect of the present disclosure, a closure mechanism for a reclosable pouch includes a first set of complementary closure profiles comprising a first female profile having first and second legs extending from a first base of a first closure element, a first sealing flange attached to each of the first and second legs and having a slit disposed therethrough to define a first sealing flap that depends from the first leg and a second sealing flap that depends from the second leg. A first male profile extends from a second base of a second closure element. The first male profile is adapted to engage a portion of at least one of the first and second sealing flaps to form a seal therebetween when the first male and the first female profiles are occluded. The closure mechanism further includes a first sealing section extending from the first closure element, the first sealing section comprising a first protuberance having a first distal surface, a second protuberance having a second distal surface, and a second sealing flange attached to the first closure element at opposite ends of the second sealing flange and extending between the first and second distal surfaces. A second sealing section comprises a sealing member having a third distal surface and extending from the second closure element such that the third distal surface is disposed between the first and second distal surfaces of the first sealing section and urges against the second sealing flange to form a seal therebetween when the first male and female profiles are occluded.

In yet another aspect of the present disclosure, a reclosable pouch includes first and second pouch sidewalls sealed to one another to define an opening, a one-way valve disposed on the pouch, and a closure mechanism comprising first and second closure elements that include first and second complementary interlocking profiles, respectively. The first closure element is attached to the first sidewall and the second closure element is attached to the second sidewall proximate to the opening to define a pouch interior. A first sealing section extends from the first closure element, and is disposed on an opening side of the first interlocking profile, the first sealing section comprises a first protuberance having a first distal surface, a second protuberance having a second distal surface, and a sealing flange attached to the first closure element at opposite ends of the sealing flange and extending between the first and second distal surfaces. A second sealing section comprises a sealing member that extends from the second closure element and is disposed on an opening side of the second interlocking profile such that a third distal surface of the sealing member is disposed between the first and second distal surfaces and urges against the sealing flange to form a seal therebetween when the first and second complementary interlocking profiles are occluded.

BRIEF DESCRIPTION OF THE DRAWINGS

Other aspects and advantages of the present disclosure will become apparent upon consideration of the following detailed description, wherein similar structures have similar reference numerals.

DETAILED DESCRIPTION

Figure 1:
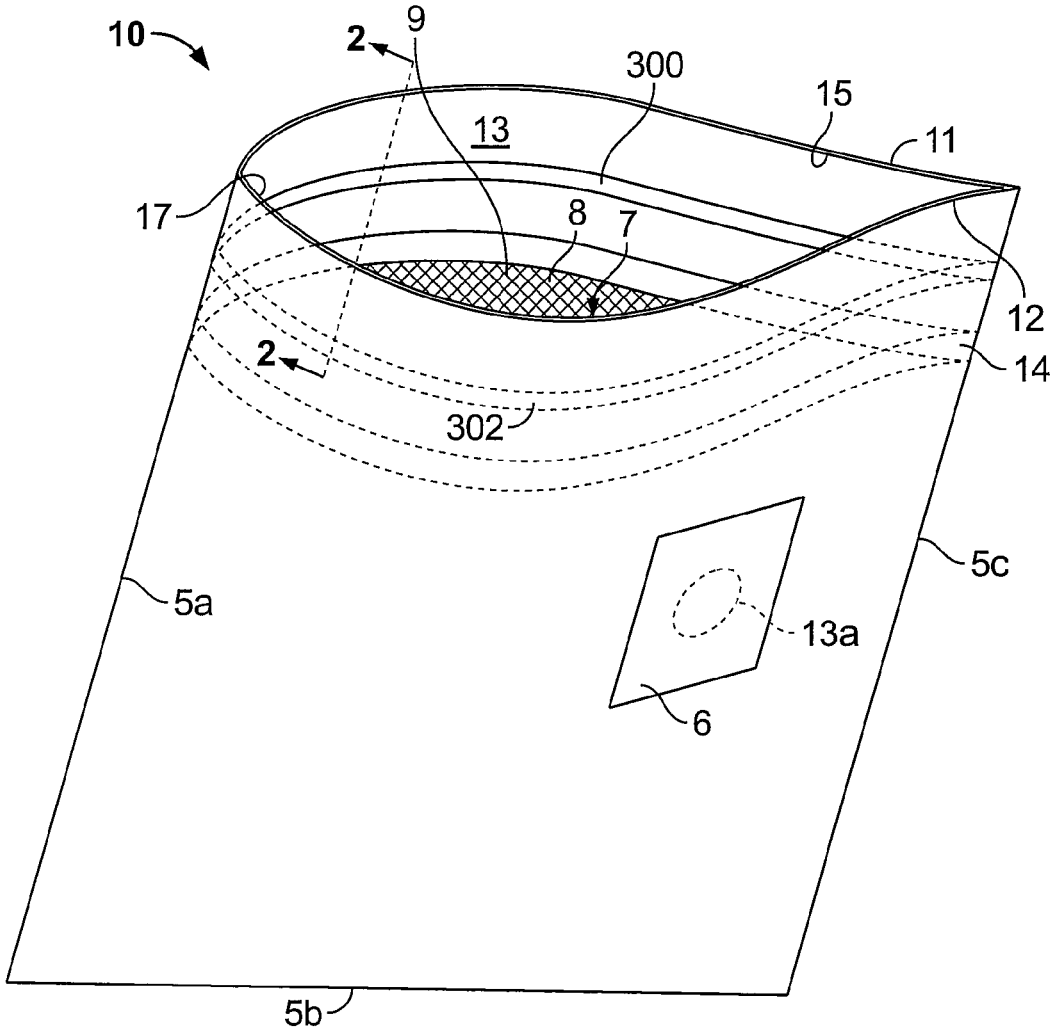
FIG. 1 is an isometric view of a reclosable pouch.

Referring to FIG. 1, a reclosable thermoplastic pouch 10 includes first and second sidewalls 11, 12 joined around three edges 5*a*-5*c* by heat sealing or other sealing method known in the art to define an opening 13. Alternatively, the bottom edge 5*b* may be a fold line between the first and second sidewalls 11, 12. A closure mechanism 14 extends from the first and second sidewalls 11, 12 proximate to the pouch opening 13. The closure mechanism 14 and the first and second sidewalls 11, 12 define a pouch interior 7. When occluded, the closure mechanism 14 provides a seal, such as a gastight or watertight seal, such that a vacuum may be maintained in the pouch interior 7 for a desired period of time, such as hours, days, months, or years, when the closure mechanism is sealed fully across the opening 13. Protuberances, for example, ridges 300, 302, may also be disposed on the inner surfaces 15, 17 of the respective first and second side walls 11, 12 proximate to the opening 13 to provide increased traction in a convenient area for a user to grip, such as a gripping flange, when trying to open the sealed pouch 10.

In one embodiment, the pouch 10 may include a second opening 13*a* through one of the sidewalls 11, 12 covered by a valve 6, such as a check or one-way valve, to allow gas to be evacuated from the pouch interior 7 and to maintain a vacuum when the closure mechanism 14 has been sealed. As shown in FIG. 1, the valve 6 may be disposed on the second sidewall 12 spaced from the closure mechanism 14. When in an open state, the valve 6 provides a fluid path with fluid communication between the pouch interior 7 and an exterior of the pouch. Illustrative valves useful in the present disclosure include those disclosed in, for example, Newrones et al. U.S. Patent Application Publication No. 2006/0228057, now U.S. Pat. No. 7,837,387, Buchman U.S. Patent Application Publication No. 2007/0172157, and Tilman et al. U.S. Patent Application Publication No. 2007/0154118. Other valves useful in the present disclosure include those disclosed in, for example, U.S. patent application Ser. No. 11/818,586, now U.S. Pat. No. 7,946,766, No. 11/818,591, now U.S. Pat. No. 7,874,731, and No. 11/818,952, now U.S. Pat. No. 7,967,509, each filed on Jun. 15, 2007. Although not shown, in some embodiments, an evacuation pump or device may be used to evacuate gas from the pouch 10 through, for example, the valve 6 disposed in one of the side walls 11, 12, or in the closure mechanism 14 or one of the side edges 5*a*, 5*b*, 5*c* of the pouch. Illustrative evacuation pumps or devices useful in the present disclosure include those disclosed in, for example, U.S. patent application Ser. No. 11/818,703, filed on Jun. 15, 2007, now U.S. Pat. No. 8,096,329, and U.S. patent application Ser. No. 12/008,164, filed on Jan. 9, 2008, published as U.S. Patent Application Publication No. 2009/0175747.

In one embodiment, the first and second sidewalls 11, 12 and/or the closure mechanism 14 are formed from thermoplastic resins by known extrusion methods. For example, the sidewalls 11, 12 may be independently extruded of a thermoplastic material as a single contiguous or multi-ply web, and the closure mechanism 14 may be extruded of the same or different thermoplastic material(s) separately as continuous lengths or strands. Illustrative thermoplastic materials include polypropylene (PP), polyethylene (PE), metallocene-polyethylene (mPE), low density polyethylene (LDPE), linear low density polyethylene (LLDPE), ultra low density polyethylene (ULDPE), biaxially-oriented polyethylene terephthalate (BPET), high density polyethylene (HDPE), polyethylene terephthalate (PET), among other polyolefin plastomers and combinations and blends thereof. Further, inner surfaces 15, 17 of the respective sidewalls 11, 12 or a portion or area thereof may, for example, be composed of a polyolefin plastomer such as an AFFINITIY™ resin manufactured by Dow Plastics. Such portions or areas include, for example, the area of one or both of the sidewalls 11, 12 proximate to and parallel to the closure mechanism 14, to provide an additional cohesive seal between the sidewalls when the pouch 10 is evacuated of gas. One or more of the sidewalls 11, 12 in other embodiments may also be formed of a gas-impermeable film. An example of a gas-impermeable film includes a film having one or more barrier layers, such as an ethylene-vinyl alcohol polymer (EVOH) ply or a nylon ply, disposed between or on one or more of the plies of the sidewalls 11, 12. The barrier layer may be, for example, adhesively secured between the PP and/or LDPE plies to provide a multilayer film. Other additives, such as colorants, slip agents, and antioxidants, including, for example, talc, oleamide or hydroxyl hydrocinnamate may also be added as desired. In another embodiment, the closure mechanism 14 may be extruded primarily of molten PE with various amounts of slip component, colorant, and talc additives in a separate process. The fully formed closure mechanism 14 may be attached to the pouch body using a strip of molten thermoplastic weld material, or by an adhesive known by those skilled in the art, for example. Other thermoplastic resins and gas-impermeable films useful in the present disclosure include those disclosed in, for example, Tilman et al. U.S. Patent Application Publication No. 2006/0048483, now U.S. Pat. No. 7,290,660.

One or both sidewalls, such as the first sidewall 11, may also be embossed or otherwise textured 8 with a pattern, such as a diamond pattern, on one or both surfaces spaced between the bottom edge 5*b* and the closure mechanism 14 to provide flow channels 9 within the pouch interior 7. In another embodiment, a separate textured or embossed pattern wall or flange(s) (not shown) may extend from the closure mechanism 14 to provide flow channels 9 within the pouch interior 7. The flow channels 9 may provide fluid communication between the pouch interior 7 and the valve 6 when gas is being drawn through the valve 6. Illustrative flow channels useful in the present disclosure include those disclosed in Zimmerman et al. U.S. Patent Application Publication No. 2005/0286808, now U.S. Pat. No. 7,726,880, Buchman U.S. Patent Application Publication No. 2007/0172157, and Tilman et al. U.S. Patent Application Publication No. 2006/0048483, now U.S. Pat. No. 7,290,660, and U.S. Patent Application Publication No. 2007/0154118. Other flow channels useful in the present disclosure include those disclosed in, for example, U.S. patent application Ser. No. 11/181,584, filed on Jun. 15, 2007, now U.S. Pat. No. 7,887,238.

The resealable bag or pouch disclosed herein can be made by various techniques known to those skilled in the art including those described in, for example, Geiger et al., U.S. Pat. No. 4,755,248. Other useful techniques to make a resealable pouch include those described in, for example, Zieke et al., U.S. Pat. No. 4,741,789. Additional techniques to make a resealable pouch include those described in, for example, Porchia et al., U.S. Pat. No. 5,012,561. Additional examples of making a resealable pouch as described herein include, for example, a cast post applied process, a cast integral process, and/or a blown process.

Figure 2A:
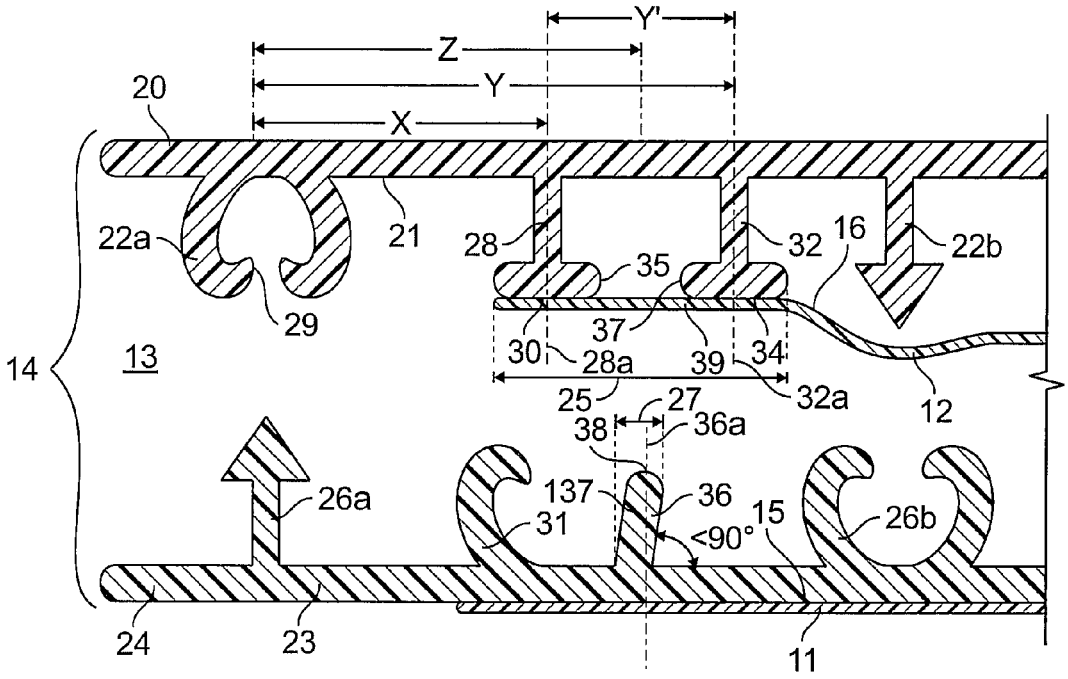
FIG. 2A is a partial cross-sectional view of a closure mechanism in a non-occluded state in accordance with one embodiment, taken generally along the lines 2-2 of FIG. 1.
Figure 2B:
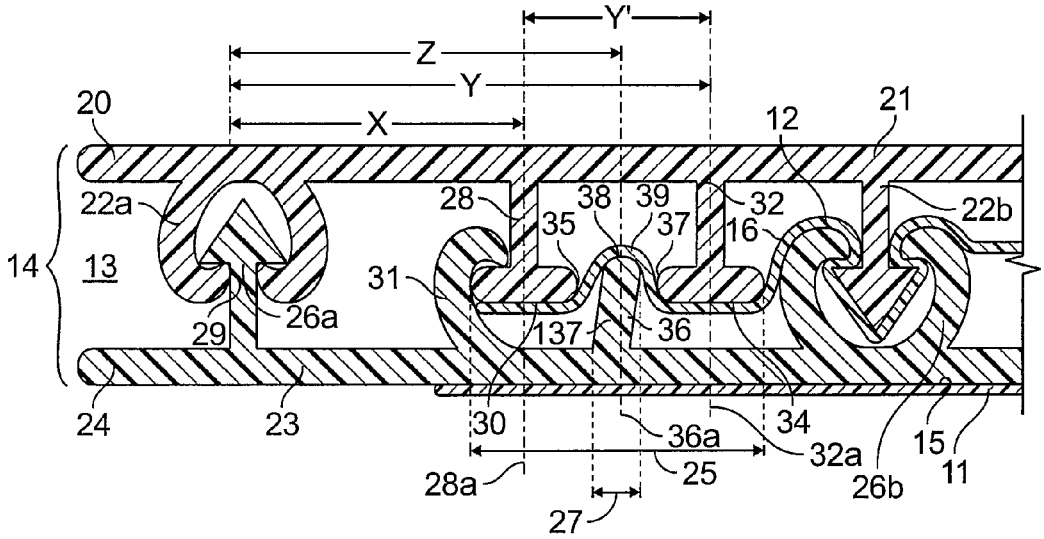
FIG. 2B is a partial cross-sectional view of a closure mechanism in an occluded state in accordance with the embodiment depicted in FIG. 2A.

Referring to FIGS. 2A and 2B, the closure mechanism 14 comprises a first closure element 20 that includes a first interlocking profile 22*a* and a second closure element 24 that includes a complementary second interlocking profile 26*a*. The first closure element 20 may also include a third interlocking profile 22*b* and the second closure element 24 may include a complementary fourth interlocking profile 26*b*. The first closure element 20 and second closure element 24 are elongate and extend along the opening 13 of the pouch 10. FIG. 2A depicts the first and second closure elements 20, 24 in a non-occluded state while FIG. 2B shows the first and second closure elements 20, 24 in an occluded state. In this embodiment, the first closure element 20 is attached to an outer surface 16 of the second sidewall 12, and the second closure element 24 is attached to the inner surface 15 of the first sidewall 11. The first and second interlocking profiles 22*a*, 26*a* are shown in FIGS. 2A and 2B as female and male closure profiles, respectively, and the third and fourth interlocking profiles 22*b*, 26*b* are shown in FIGS. 2A and 2B as male and female closure profiles, respectively. However, the configuration and geometry of the interlocking profiles 22*a*, 22*b*, 26*a*, 26*b*, closure elements 20, 24, or any other interlocking profiles or closure elements discussed or shown herein may vary as known to those skilled in the art.

In a further embodiment (not shown), one or both of the first and second closure elements 20, 24 may include one or more textured portions, such as bump or crosswise grooves in one or more of the interlocking profiles 22*a*, 22*b*, 26*a*, 26*b* in order to provide a tactile sensation, such as a series of clicks, as a user draws the fingers along the closure mechanism 14 to seal the closure elements across the opening. In another embodiment, all of the closure profiles 22*a*, 22*b*, 26*a*, 26*b* include textured portions along the length of each profile to provide tactile and/or audible sensations when closing the closure mechanism 14. Further, in some embodiments, a sealing material, such as a polyolefin material, or a caulking composition, such as silicone grease, may be disposed on or in the interlocking profiles 22*a*, 22*b*, 26*a*, 26*b* or closure elements 20, 24 to fill in any gaps or spaces therein when occluded. The ends of the interlocking profiles 22*a*, 22*b*, 26*a*, 26*b* or closure elements 20, 24 may also be welded or sealed by ultrasonic vibrations, as is known in the art. Illustrative interlocking profiles, closure elements, sealing materials, tactile or audible closure elements, and/or end seals useful in the present disclosure include those disclosed in, for example, Pawloski U.S. Pat. No. 4,927,474, Dais et al. U.S. Pat. No. 5,070,584, No. 5,478,228, and No. 6,021,557, Tomic et al. U.S. Pat. No. 5,655,273, Sprehe U.S. Pat. No. 6,954,969, Kasai et al. U.S. Pat. No. 5,689,866, Ausnit U.S. Pat. No. 6,185,796, Wright et al. U.S. Pat. No. 7,041,249, Pawloski et al. U.S. Pat. No. 7,137,736, Anderson U.S. Patent Application Publication No. 2004/0091179, now U.S. Pat. No. 7,305,742, Pawloski U.S. Patent Application Publication No. 2004/0234172, now U.S. Pat. No. 7,410,298, Tilman et al. U.S. Patent Application Publication No. 2006/0048483, now U.S. Pat. No. 7,290,660, and Anzini et al. U.S. Patent Application Publication No. 2006/0093242 and No. 2006/0111226, now U.S. Pat. No. 7,527,585. Other interlocking profiles and closure elements useful in the present disclosure include those disclosed in, for example, U.S. patent application Ser. No. 11/725,120, filed Mar. 16, 2007, now U.S. Pat. No. 7,886,412, and U.S. patent application Ser. No. 11/818,586, now U.S. Pat. No. 7,946,766, and No. 11/818,593, now U.S. Pat. No. 7,784,160, each filed on Jun. 15, 2007. It is further appreciated that the interlocking profiles or closure elements disclosed herein may be operated by hand, or a slider (not shown) may be used to assist in occluding and de-occluding the interlocking profiles and closure elements.

As shown in FIGS. 2A and 2B, a first sealing section 25 is disposed on the first closure element 20 between the first and third interlocking profiles 22*a*, 22*b*, and includes a first protuberance 28 having a distal surface 30 and extending from an elongate first base 21 of the first closure element. A central axis 28*a* of the first protuberance 28 is located a distance X measured along the first base 21 from a line perpendicular to the base and through a distal end 29 of the first interlocking profile 22*a*. This spacing of the central axis 28*a* of the first protuberance 28 at a distance X allows for proper securement of the first and the second closure elements 20, 24 and may range, for example, from greater than about 0.04 inches to less than about 0.20 inches. The first sealing section 25 also includes a second protuberance 32 having a distal surface 34 and extending from the elongate first base 21 of the first closure element 20. A central axis 32*a* of the second protuberance 32 is located a distance Y measured along the first base 21 from a line perpendicular to the base and through the distal end 29 of the first interlocking profile 22*a*. In this embodiment, the distance Y is greater than the distance X, and the difference is represented by distance Y'. Illustratively, the distance Y' between the central axes 28*a* and 32*a* allows for a sealing flange 29 to extend from and across the distal surfaces 30, 34 of the first and second protuberances 28, 32, respectively. In this embodiment, the sealing flange 39 is integral with the second pouch sidewall 12, and, in other embodiments, the sealing flange 39 may be a separate piece of thermoplastic film that extends across the distal surfaces 30, 34.

A second sealing section 27 that is complementary to the first sealing section 25 is disposed on the second closure element 24 between the second and fourth interlocking profiles 26*a*, 26*b*, and includes a sealing member 36 having a distal surface 38. In this embodiment, the distal surface 38 is disposed at an apex of a third protuberance 137 that extends from an elongate second base 23 of the second closure element 24. Although in this embodiment the third protuberance 137 is disposed at an angle of less than about ninety degrees relative to the second base 23, it is also contemplated that the third protuberance may be disposed at angles of about ninety degrees or greater than about ninety degrees. However, by having the third protuberance 137 at a non-ninety degree angle, the force necessary to urge the sealing member 36 and the sealing flange 39 together may be less due to the flexibility of the third protuberance as force is applied thereto while the first and second closure elements 20, 24 are being occluded. This flexibility increases as the angle increases past about ninety degrees or decreases to less than about ninety degrees, and may, in some instances, assist in maintaining a seal with the sealing flange 39 due to, for example, flexing of the first and second closure elements 20, 24 as the pouch 10 is handled by a user. A central axis 36*a* of the distal surface 38 of the sealing member 36 is located a distance Z measured along the first base 21 from a line perpendicular to the base and through the distal end 29 of the first interlocking profile 22*a* when the closure elements 20 and 24 are occluded. In this embodiment, the central axis 36*a* of the distal surface 38 does not correspond to a central axis (not shown) of the third protuberance 137. The distance Z ranges between the distances X and Y in this embodiment, such that the central axis 36*a* is disposed between opposing outer edges 35, 37 of the distal surfaces 30, 34, respectively, in the occluded state, as shown in FIG. 2B.

When the closure elements 20, 24 are urged together, the first interlocking profile 22*a* interlocks with the second interlocking profile 26*a*, and the third interlocking profile 22*b* interlocks with the fourth interlocking profile 26*b*. In this embodiment, because the sealing flange 39 is integral with the second pouch sidewall 12, the third and fourth interlocking profiles 22*b*, 26*b* interlock with the sealing flange trapped therebetween. In other embodiments, the sealing flange 39 may be made of a thermoplastic film independent of the sidewalls 11, 12 such as, for example, an elastomer or a polyolefin plastomer such as an AFFINITY™ resin, and the third and fourth interlocking profiles 22*b*, 26*b* may interlock without the sealing flange trapped therebetween. Additionally, in the occluded state, the first protuberance 28 interlocks with an asymmetrically-hooked protuberance 31 that extends from the elongate second base 23 of the second closure element 24. Although the first and second protuberances 28, 32 are illustrated in FIGS. 2A and 2B as T-shaped protuberances and a post shape is shown for the sealing member 36, other shapes may also be used, including, for example, bulbous members, arrow or half-arrow shaped members, or rectangular, square-shaped, round or triangular-shaped protrusions, as well as any combination thereof.

Figure 3A:
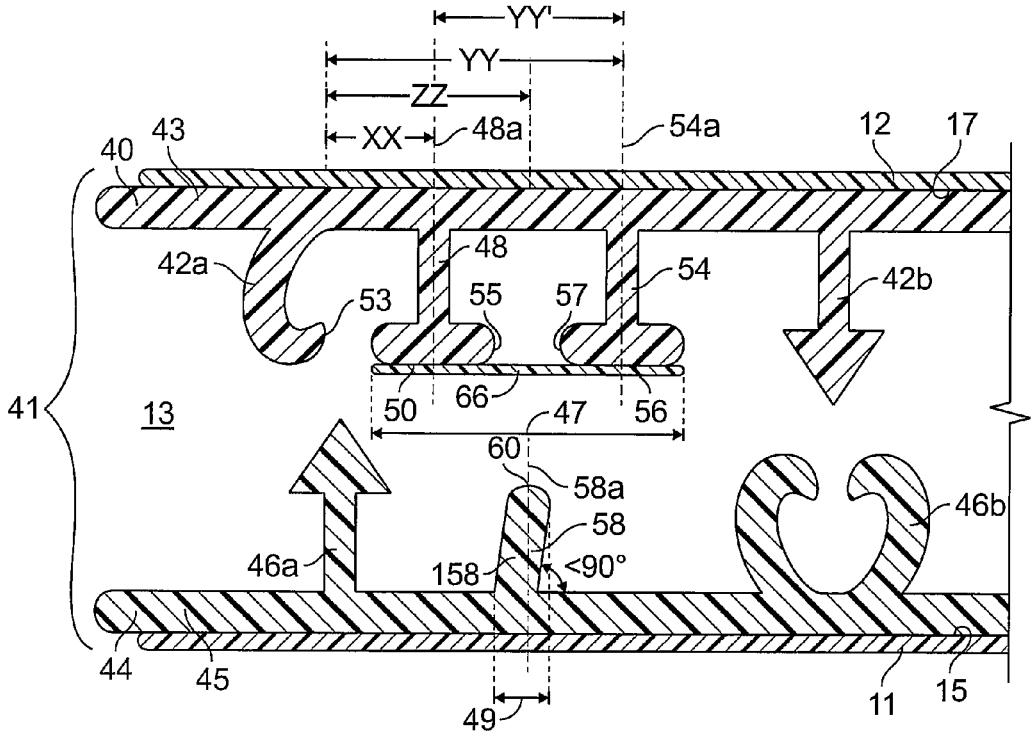
FIG. 3A is a partial cross-sectional view of another embodiment in a non-occluded state, taken generally along the lines 2-2 of FIG. 1.
Figure 3B:
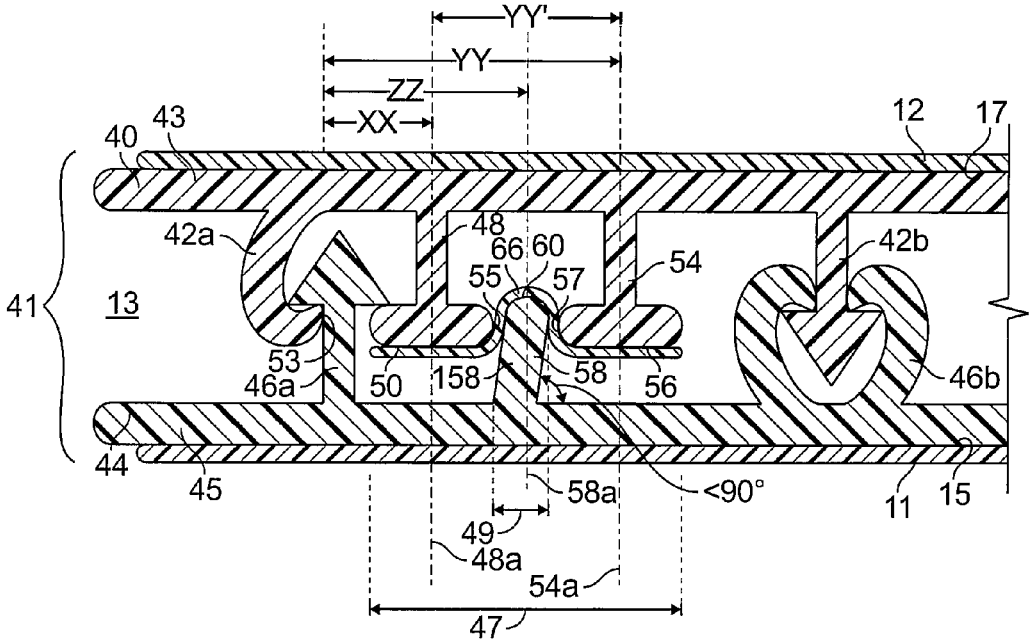
FIG. 3B is a partial cross-sectional view of the embodiment depicted in FIG. 3A in an occluded state.

In another embodiment, illustrated in FIGS. 3A and 3B, a closure mechanism 41 includes a first closure element 40 having a first interlocking profile 42*a* and a second closure element 44 having a complementary second interlocking profile 46*a*. The first closure element 40 may also include a third interlocking profile 42*b* and the second closure element 44 may include a complementary fourth interlocking profile 46*b*. FIG. 3A depicts the first and second closure elements 40, 44 in a non-occluded state while FIG. 3B shows the first and second closure elements 40, 44 in an occluded state. In this embodiment, the first closure element 40 is attached to the inner surface 17 of the second sidewall 12 and the second closure element 44 is attached to the inner surface 15 of the first sidewall 11. Illustratively, the first and fourth interlocking profiles 42*a*, 46*b* are shown as female and the second and third interlocking profiles 46*a*, 42*b* are shows as male closure profiles, however, the configuration and geometry of the interlocking profiles 42*a*, 42*b*, 46*a*, 46*b* or closure elements 40, 44 may vary as described previously herein.

A first sealing section 47 extends from an elongate first base 43 of the first closure element 40 and contains a first protuberance 48 and a second protuberance 54, each having one or more sidewalls that extend substantially perpendicularly from the elongate first base 43. The first protuberance 48 has a distal surface 50 and a central axis 48*a* located a distance XX measured along the first base 43 from a line perpendicular to the base and through the distal end 53 of the first interlocking profile 42*a*. The second protuberance 54 has a distal surface 56 and a central axis 54*a* of the second protuberance 54 is located a distance YY measured along the first base 43 from a line perpendicular to the base and through the distal end 53 of the first interlocking profile 42*a*. In this embodiment, the distance YY is greater than the distance XX, and the difference is represented by distance YY'. Illustratively, the distance YY' between the central axes 48*a* and 54*a* provides a spacing between the distal surfaces 50, 56 of the first and second protuberances 48, 54 respectively. A sealing flange 66 is attached to the distal surface 50 of the first protuberance 48 and the distal surface 56 of the second protuberance 54 and extends across the spacing represented by the distance YY'.

A second sealing section 49 includes a sealing member 58 having a distal surface 60 disposed at an apex of a third protuberance 158 that extends similar to that as shown in FIGS. 2A and 2B at an angle of less than about ninety degrees from an elongate second base 45 of the second closure element 44. In this embodiment, the sealing member 58 has one or more sidewalls that extend substantially parallel to one another from the elongate second base 45. A central axis 58*a* of the distal surface 60 of the sealing member 58 is located a distance ZZ measured along the first base 43 from a line perpendicular to the base and through the distal end 53 of the first interlocking profile 42*a* when the closure elements 40 and 44 are occluded. In this embodiment, the central axis 58*a* of the distal surface 60 does not correspond to a central axis (not shown) of the third protuberance 158. The distance ZZ ranges between the distances XX and Y in this embodiment, such that the central axis 58*a* is disposed between opposing outer edges 55, 57 of the distal surfaces 50,56, respectively, in the occluded state, as shown in FIG. 3B.

In this embodiment, the sealing flange 66 may be made of a thermoplastic film independent of the sidewalls 11, 12, such as, for example, an elastomer or a polyolefin plastomer, such as an AFFINITY™ resin. However, in other embodiments, the sealing flange 66 may be made of one of the sidewalls 11, 12 or of the same or similar material(s). When the first closure element 40 and the second closure element 44 are urged together, as shown in FIG. 3B, the first interlocking profile 42*a* interlocks with the second interlocking profile 46*a* and the third interlocking profile 42*b* interlocks with the fourth interlocking profile 46*b*. In the occluded state, the sealing member 58 is urged against the sealing flange 66 to form a seal therebetween.

Figure 4A:
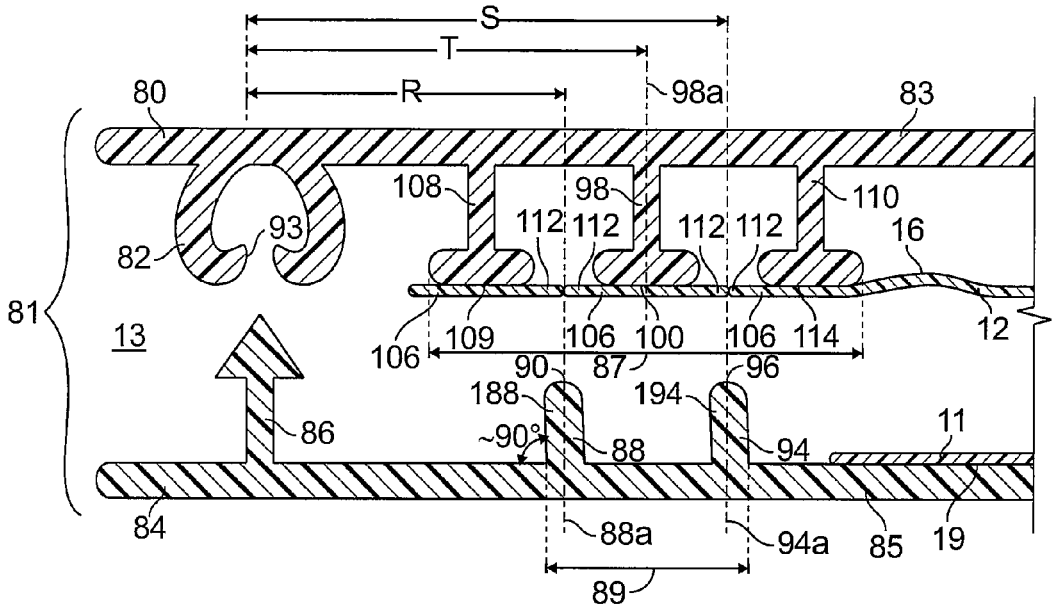
FIG. 4A is a partial cross-sectional view of a further embodiment in a non-occluded state, taken generally along the lines 2-2 of FIG. 1.
Figure 4B:
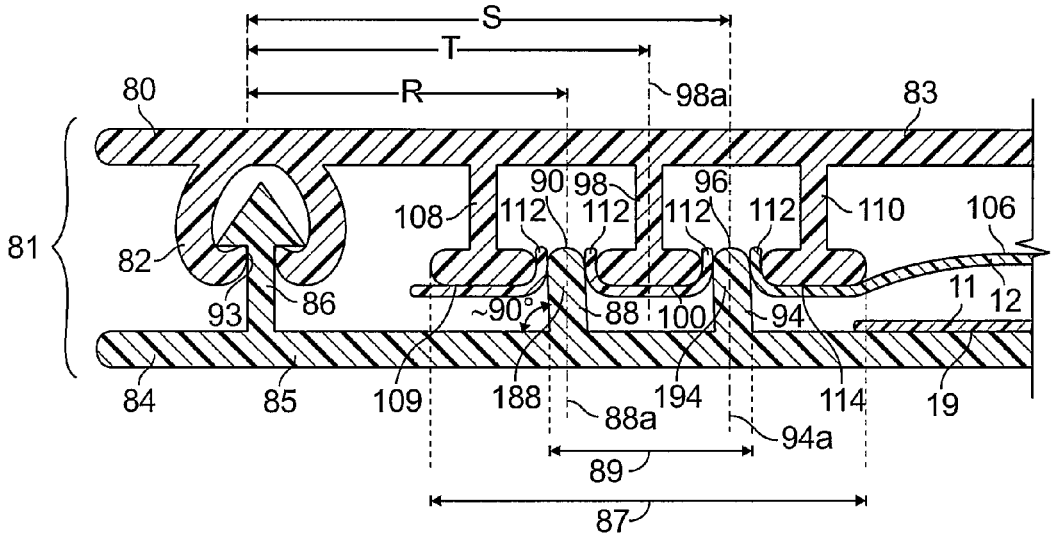
FIG. 4B is a partial cross-sectional view of the embodiment depicted in FIG. 4A in an occluded state.

Referring to FIGS. 4A and 4B, the closure mechanism 81 includes a first closure element 80 that has a first interlocking profile 82 and a second closure element 84 and includes a complementary second interlocking profile 86. FIG. 4A depicts the first and second closure elements 80, 84 in a non-occluded state, while FIG. 4B shows the first and second closure elements 80, 84 in an occluded state. In this embodiment, the first closure element 80 is attached to the outer surface 16 of the second sidewall 12, and the second closure element 84 is attached to an outer surface 19 of the first sidewall 11.

A first sealing section 87 disposed on the first closure element 80 includes a first protuberance 98 having a distal surface 100 and extending from an elongate first base 83 of the first closure element. A central axis 98*a* of the first protuberance 98 is located a distance T measured along the first base 83 from a line perpendicular to the base and through a distal end 93 of the first interlocking profile 82. The first sealing section 87 also includes a second and third protuberance, 108, 110, respectively positioned on either side of the first protuberance 98. The second and third protuberances 108, 110 extend from the elongate first base 83 of the first closure element 80 had have respective distal surfaces 109, 114.

A second sealing section 89 disposed on the second closure element 84 includes a first sealing member 88 having a distal surface 90 disposed at an apex of a fourth protuberance 188 that extends about ninety degrees or perpendicularly from an elongate second base 85 of the second closure element. A central axis 88*a* of the distal surface 90 generally corresponds in this embodiment to that of the first sealing member 88 and is located a distance R measured along the first base 83 from a line perpendicular to the base and through the distal end 93 of the first interlocking profile 82 when the closure elements 80 and 84 are occluded. The second sealing section 89 further includes a second sealing member 94 having a distal surface 96 that is disposed at an apex of a fifth protuberance 194 and also extends about ninety degrees or perpendicularly from the elongate second base 85 of the second closure element 84. A central axis 94*a* of the distal surface 96 also generally corresponds to that of the second sealing member 94 and is located a distance S measured along the first base 83 from a line perpendicular to the base and through the distal end 93 of the first interlocking profile 82 when the closure elements 80 and 84 are occluded. In this embodiment, the distance S is greater than the distance T, which is greater than the distance R, such that the central axis 88*a* is disposed between the first and third protuberances 98, 110, in the occluded state, as shown in FIG. 4B. Although both of the first and second sealing members 88, 94 have generally perpendicularly disposed respective fourth and fifth protuberances 188, 194, it is also contemplated that one or both may be disposed at an angle less than about ninety degrees.

A sealing flange 106 having slits disposed therethrough is attached respectively to the distal surfaces 100, 109, 114 of the first, second, and third protuberances, 98, 108, 110, respectively. In this embodiment, the sealing flange 106 is a part of the second sidewall 12. However, in other embodiments, the sealing flange 106 may be made of a film independent of sidewalls 11, 12, such as, for example, an elastomer or a polyolefin plastomer, such as an AFFINITY™ resin. The sealing flange 106 also includes slit along a length thereof to form film flaps 112 to allow penetration of the first and second sealing members 88, 94 into spaces between the first protuberance 98 and the second protuberance 108 and the first protuberance 98 and the third protuberance 110, respectively, when the first closure element 80 and second closure element 84 are occluded. In the occluded state shown in FIG. 4B, the film flaps 112 are urged against respective surfaces of the first, second, third, fourth, and fifth protuberances 98, 108, 110, 188, 194 to form gastight seals between the first and second sealing members 88, 94 and the sealing flange 106. However, in other embodiments (not shown), the first and second sealing members 88, 94 may be further spaced from the respective first, second and third protuberances 98, 108,110. In these embodiments, the film flaps 112 form a seal with the first and second sealing members 88, 94 and have little or not contact with the respective surfaces of the first, second, and third protuberances 98, 108, 118. In FIGS. 4A and 4B, the sidewalls of the first through fifth protuberances 98, 108, 110, 188, 194 are substantially parallel and perpendicular relative to the elongate first and second bases 83, 85, but it is contemplated that any angle or shaped wall including straight, curved, arched, or serpentine, for example, may be used.

Figure 5A:
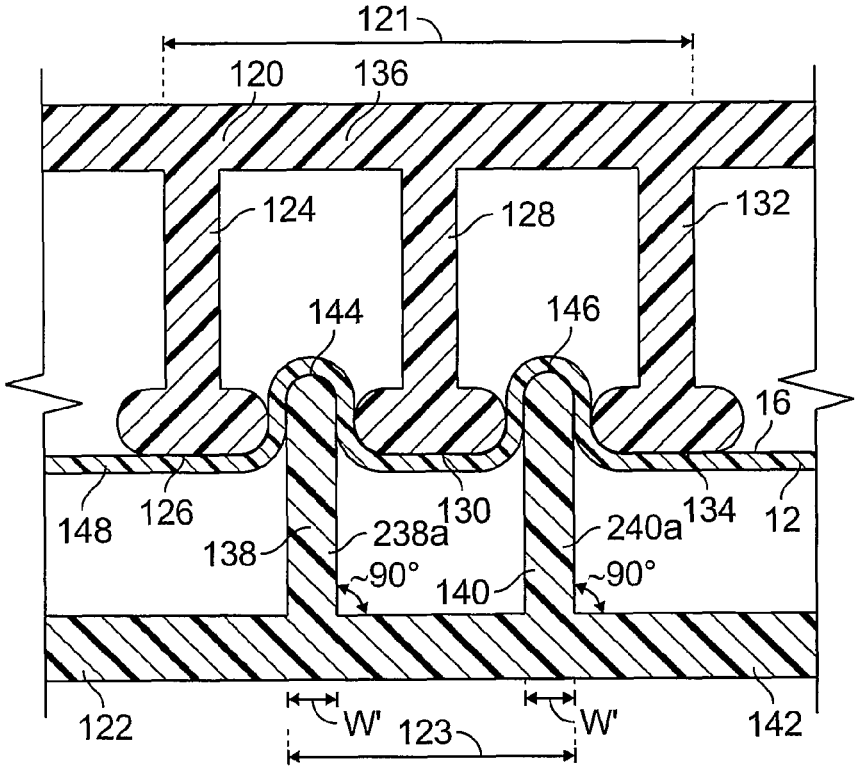
FIG. 5A is a partial cross-sectional view of yet another embodiment, taken generally along the lines 2-2 of FIG. 1.
Figure 5B:
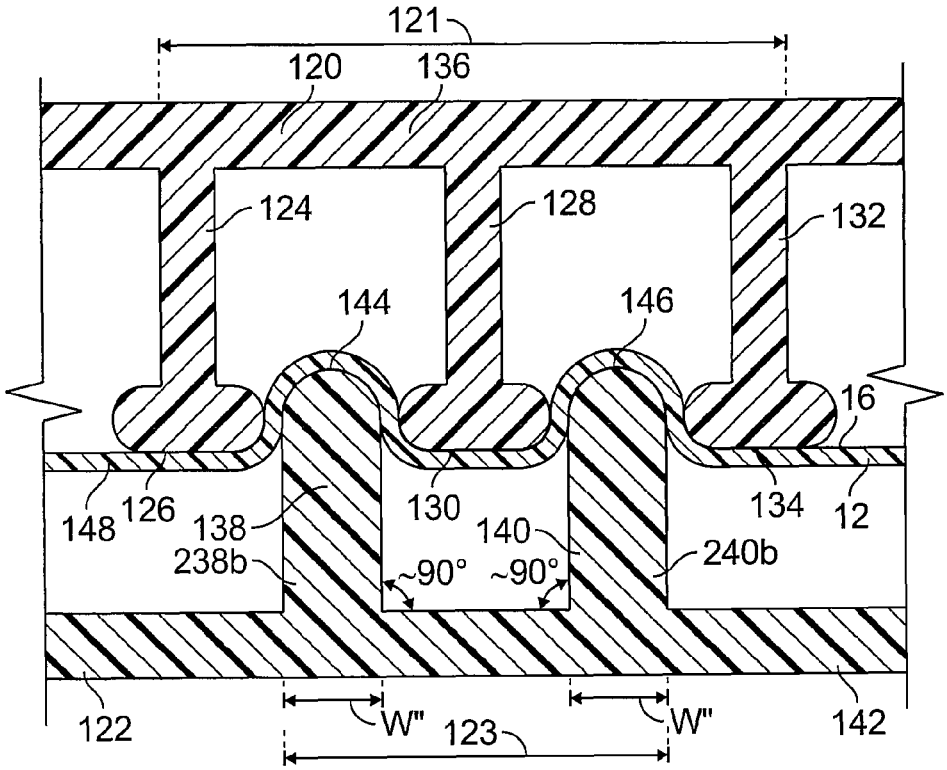
FIG. 5B is a partial cross-sectional view of a still further embodiment, taken generally along the lines 2-2 of FIG. 1.

Referring to FIGS. 5A and 5B, a first closure element 120 is attached to the outer surface 16 of the second sidewall 12 and a second closure element 122 is attached (not shown) either to the inner or outer surfaces 15, 17 of the first sidewall 11. A first sealing section 121 includes a first protuberance 124 having a distal surface 126, a second protuberance 128 having a distal surface 130, and a third protuberance 132 having a distal surface 134, wherein each of the protuberances 124, 128, 132 extends from an elongate first base 136 of the first closure element 120. A second sealing section 123 includes a first sealing member 138 having a distal surface 144 and a second sealing member 140 having a distal surface 146, wherein each of the first and second sealing members 138, 140 extends approximately perpendicularly or about ninety degrees from an elongate second base 142 of the second closure element 122. A sealing flange 148 extends across and is attached to the distal surfaces 126, 130, 134 of the first, second and third protuberances 124, 128, 132, respectively. In the occluded state, each of the first and second sealing members 138, 140 is urged against the sealing flange 148 to form a seal therebetween.

In FIG. 5A, each sealing member 138, 140 has respective fourth and fifth protuberances 238*a*, 240*a* that each has a width of W'. In FIG. 5B, each of the fourth and fifth protuberances 238*b*, 240*b* has a width of W". The increased width (W") of each of the fourth and fifth protuberances 238*b*, 240*b* in FIG. 5B relative to each of the fourth and fifth protuberances 238*a*, 240*a* of width W' in FIG. 5A results in an increased surface area upon which to contact the sealing flange 148. The increase in surface area results in a larger portion of the sealing flange 148 being contacted by the first and second sealing members 138, 140 in the occluded state, which may enhance sealing performance. Other ways to enhance sealing performance include, for example, creating a tighter interference fit between the sealing flange 148 and one or more of the sealing members, such as the first and second sealing members 138, 140. Illustratively, this can be achieved by increasing the length of the fourth or fifth protuberances 238*a*, 238*b*, or 240*a*, 240*b*, or the length of one or more of the first, second, or third protuberances 124, 128, 132. When the respective closure elements 120, 122 are urged together and become occluded, greater force may be required to occlude the closure elements due to a greater force required to urge the first and second sealing members 138, 140 and the sealing flange 148 together to form a seal. Still other ways to enhance sealing performance include, for example, using a thicker web or using multiple plies of material (not shown) to form a thicker sealing flange 148, or using a more resilient material to create a tighter interference fit between the first and second sealing members 138, 140 and the sealing flange.

Figure 6A:
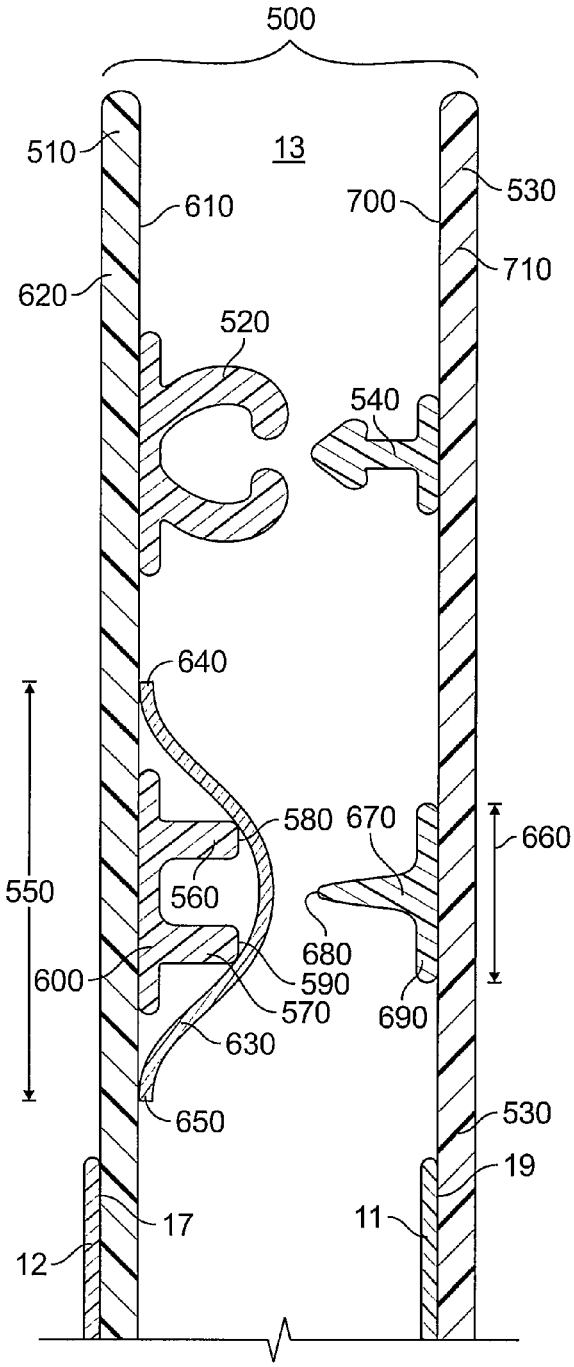
FIG. 6A is a partial cross-sectional view of another embodiment, taken generally along the lines 2-2 of FIG. 1.
Figure 6B:
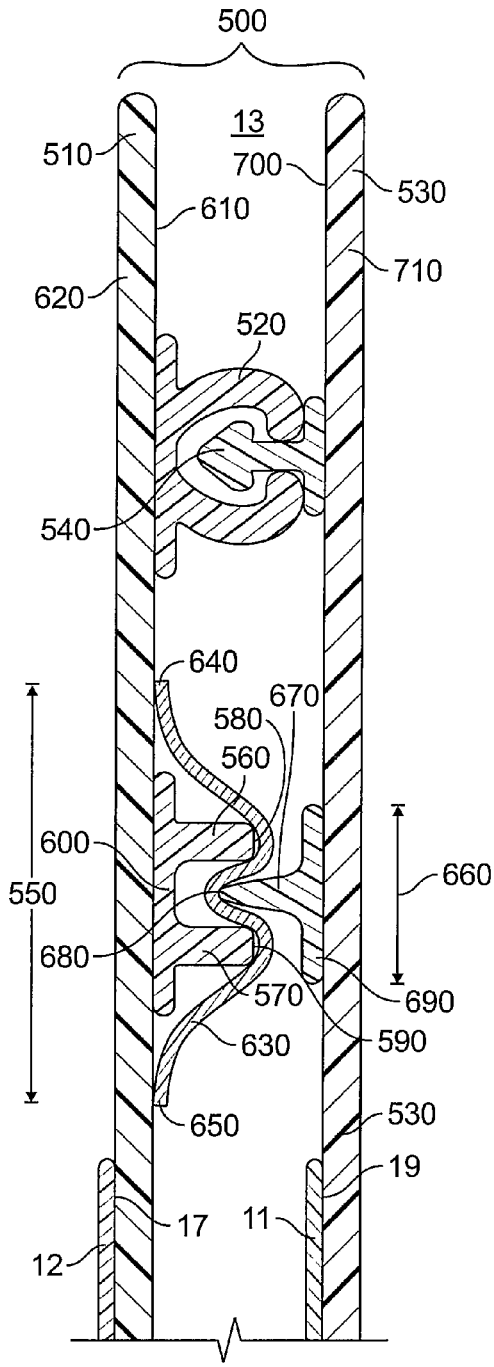
FIG. 6B is a partial cross-sectional view of the embodiment depicted in FIG. 6A in an occluded state.

Referring to FIGS. 6A and 6B, in another embodiment, a closure mechanism 500 comprises a first closure element 510 that includes a first interlocking profile 520 and a second closure element 530 that includes a complementary second interlocking profile 540. The first closure element 510 and second closure element 530 are elongate and extend along the opening 13 of the pouch 10 shown in FIG. 1. FIG. 6A depicts the first and second closure elements 510,530 in a non-occluded state, while FIG. 6B shows the first and second closure elements in an occluded state. In this embodiment, the first closure element 510 is attached to the inner surface 17 of the second sidewall 12, and the second closure element 530 is attached to the outer surface 19 of the first sidewall 11.

A first sealing section 550 is disposed on the first closure element 510 on a side of the first closure profile 520 opposite to the opening 13. The first sealing section 550 includes first and second protuberances 560 and 570, respectively, having distal surfaces 580 and 590, and each integral with and extending from a first flange 600. The first flange 600 and the first interlocking profile 520 may be integral with the base 620, or the first flange 600 and the first interlocking profile 520 may each be independently attached to an inner surface 610 of a first base 620 of the first closure element 510. A sealing flange 630 is disposed over and in contact with each of the distal surfaces 580 and 590. The sealing flange 630 is attached to the first base 620 at a first end 640 of the sealing flange and also at a second end 650 of the sealing flange. The first flange 600, the first interlocking profile 520, and the sealing flange 630 may each be independently attached to the first base 620 by any method known in the art, for example, by a thermoplastic weld layer, a heat seal, or an adhesive.

A second sealing section 660 is disposed on the second closure element 530 on a side of the second closure profile 540 opposite to the opening 13. The second sealing section 660 includes a sealing member 670 that has a distal surface 680. The sealing member 670 is integral with and extends from a second flange 690. The sealing member 670 is positioned such that the distal surface 680 thereof presses into the sealing flange 630 between the first and second protuberances 560, 570 when the first and second closure elements 510, 530 are occluded. The second flange 690 and the second interlocking profile 540 may be integral with a second base 710 of the second closure element 530, or may each be independently attached to an inner surface 700 of the second base of the second closure element.

When the first and second closure elements 510, 530 are occluded, as shown in FIG. 6B, the first interlocking profile 520 interlocks with the second interlocking profile 540. The sealing member 670 presses into the sealing flange 630 to form a seal between the sealing flange and the sealing member. The sealing flange 630 and the sealing member 670 may each independently be made of a material that is the same as or different from the first and second bases 620, 710 and the sidewalls 11, 12, such as, for example, an elastomer or a polyolefin plastomer, such as an AFFINITY™ resin. Although the first and second protuberances 56, 570 and the sealing member 670 are each illustrated in FIGS. 6A and 6B as simple posts, other shapes may also be used, including, for example, bulbous, arrow or half-arrow shaped, T-shaped, rectangular, square-shaped, round, or triangular-shaped, as well as any combination thereof.

Although, in this embodiment, the sealing member 670 is shown in FIGS. 6A and 6B to be perpendicularly disposed to the second base 710, it is also contemplated that the sealing member 670 may be disposed relative to the second base at an angle of less than about ninety degrees or greater than about ninety degrees. As described above with regard to FIGS. 2A and 2B, by having the sealing member 670 at a non-ninety degree angle, the force necessary to urge the sealing member 670 and the sealing flange 630 together may be less due to the flexibility of the sealing member 670 as force is applied thereto while the first and second closure elements 510, 530 are being occluded.

Figure 7A:
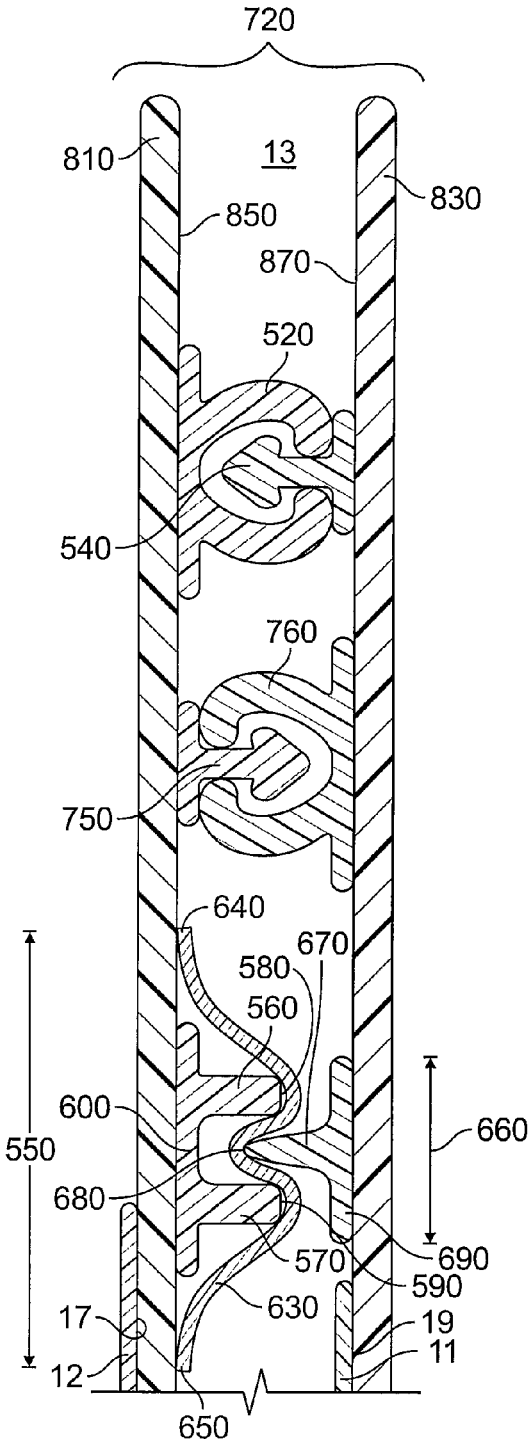
FIG. 7A is a partial cross-sectional view of yet a further embodiment, taken generally along the lines 2-2 of FIG. 1.

Another embodiment, shown in FIG. 7A, is similar to the embodiment discussed with regard to FIGS. 6A and 6B except for the following additions. A closure mechanism 720 includes a third interlocking profile 750 disposed on a first closure element 810 between the first interlocking profile 520 and the first sealing section 550. A corresponding fourth interlocking profile 760 is disposed on a second closure element 830 between the second interlocking profile 540 and the second sealing section 660. The third and fourth interlocking profiles 750 and 760 are shown in FIG. 7A as male and female closure profiles, respectively. The configuration and geometry of the third and fourth interlocking profiles 750 and 760 shown, however, may vary as previously described herein.

Further, the third interlocking profile 750 and the fourth interlocking profile 760 may be integral with the first and second closure elements 810, 830, respectively. The third and fourth interlocking profiles 750, 760 may also each be independently attached to respective inner surfaces 850, 870 of the respective first and second closure elements 810, 830. The addition of the third and fourth closure profiles 750, 760 may provide additional closure strength to inhibit the pouch from inadvertently opening.

Figure 7B:
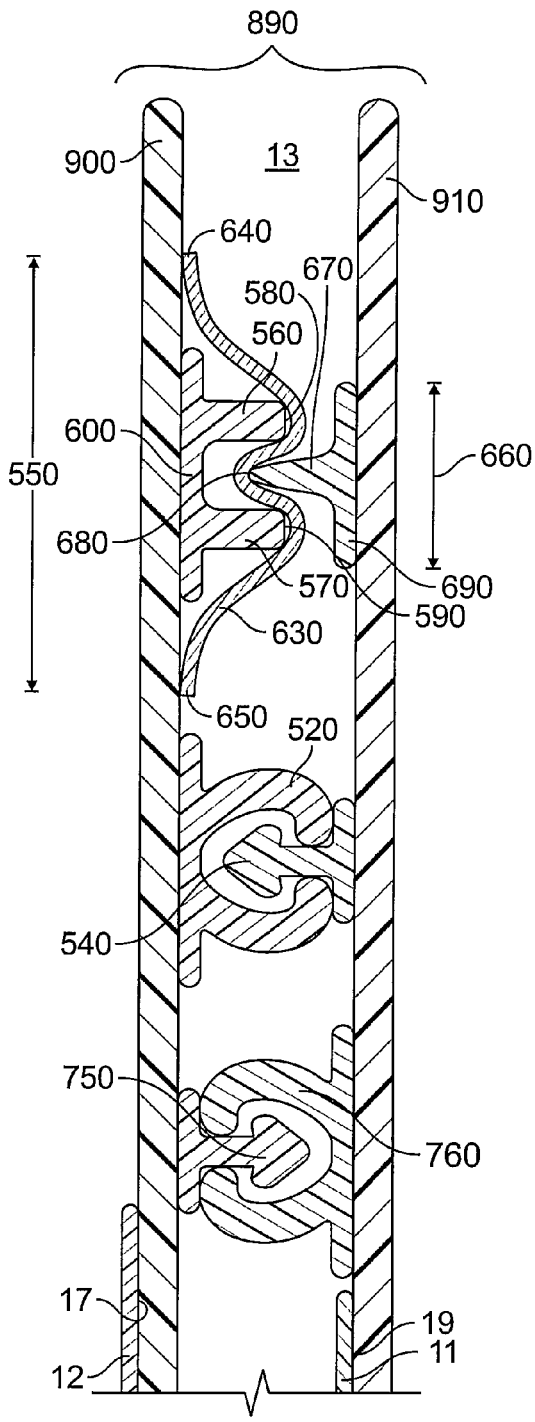
FIG. 7B is a partial cross-sectional view of still another embodiment, taken generally along the lines 2-2 of FIG. 1.

A further embodiment, shown in FIG. 7B, is similar to the embodiment discussed with regard to FIG. 7A, except for the following difference. A closure mechanism 890 includes the first sealing section 550 disposed on a first closure element 900 on a side of the first interlocking profile 520 that is adjacent to the opening 13, and the second sealing section 660 disposed on a second closure element 910 on a side of the second interlocking profile 540 that is adjacent to the opening. Placement of the interlocking profiles 520, 540, 750, 760 on a product side of the sealing sections 600, 660 may allow the sealing section to maintain a seal against increased pressure from the pouch interior 7 (shown in FIG. 1) by providing additional closure strength on the product side of the sealing sections. It is also contemplated that a single complementary pair of interlocking profiles, for example, the first and second interlocking profiles 520, 540 or the third and fourth interlocking profiles 750, 760 may be disposed on a product side of the first and second sealing sections 600 and 660.

Figure 8:
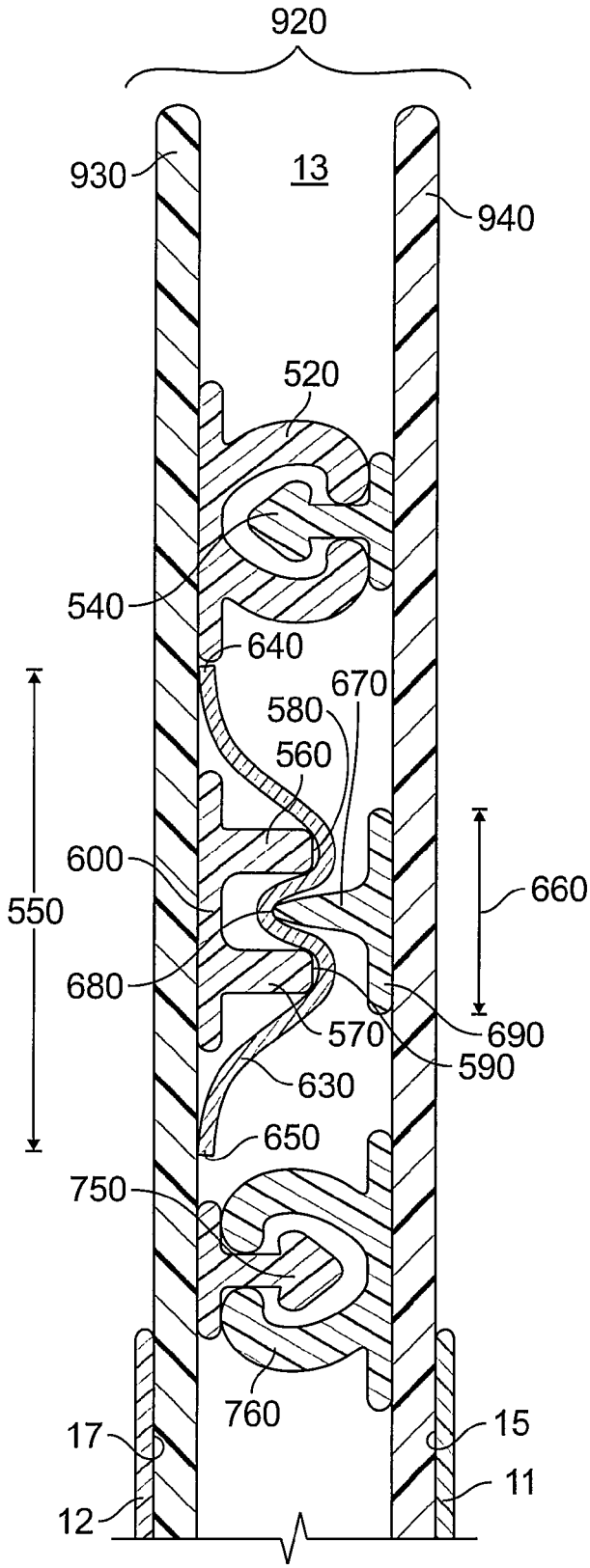
FIG. 8 is a partial cross-sectional view of a still further embodiment, taken generally along the lines 2-2 of FIG. 1.

A still further embodiment, shown in FIG. 8, is similar to the embodiment discussed with regard to FIG. 7B, except for the following differences. A closure mechanism 920 includes the first sealing section 550 disposed on a first closure element 930 between the first and third interlocking profiles 520, 750, and the second sealing section 660 disposed on a second closure element 940 between the second and fourth interlocking profiles 540, 760. In this embodiment, the first closure element 930 is attached to the inner surface 17 of the second sidewall 12, and the second closure element 940 is attached to the inner surface 15 of the first sidewall 11.

Figure 9A:
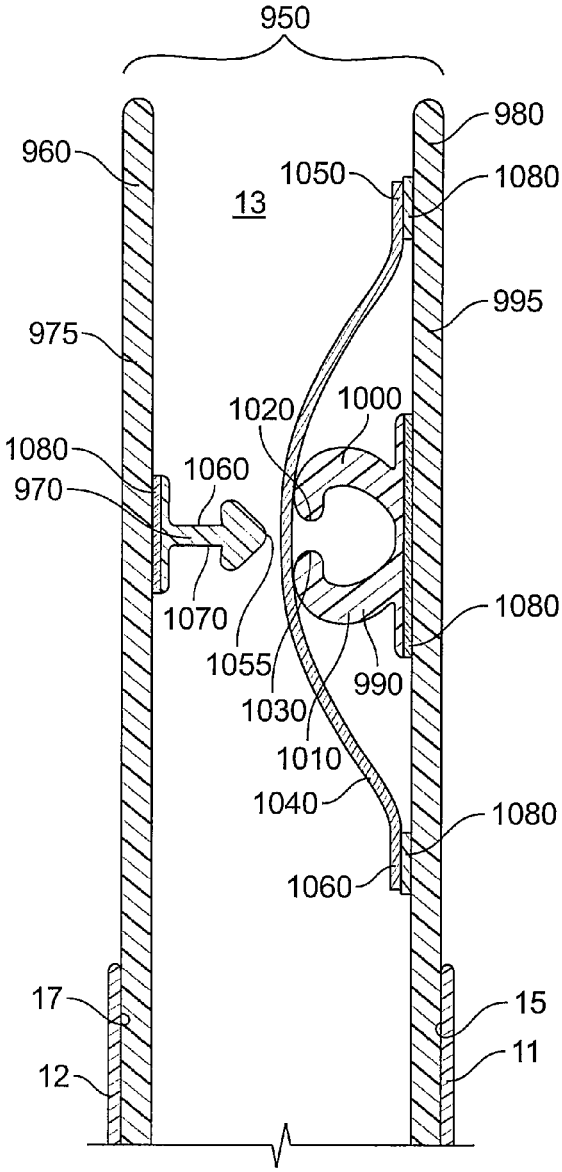
FIG. 9A is a partial cross-sectional view of another embodiment, taken generally along the lines 2-2 of FIG. 1.
Figure 9B:
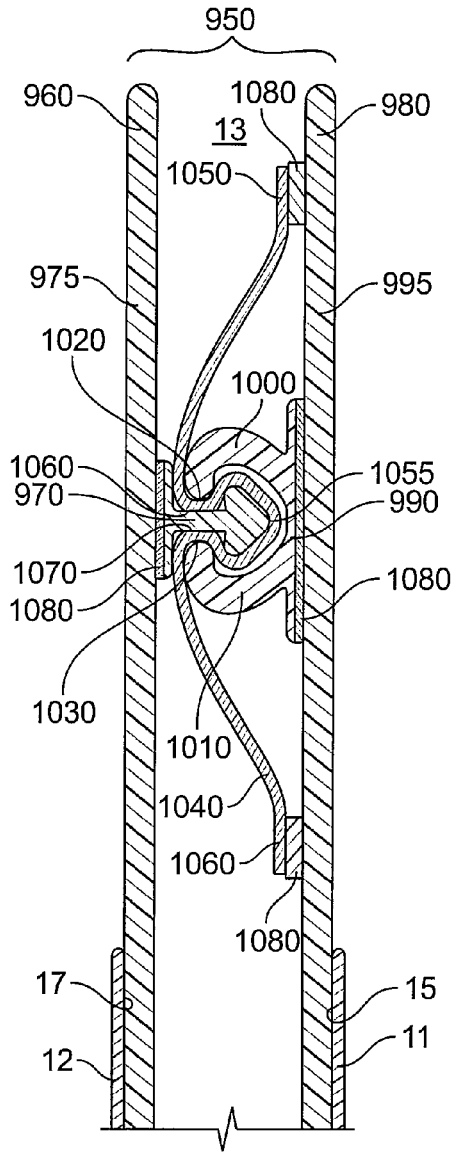
FIG. 9B is a partial cross-sectional view of the embodiment depicted in FIG. 9A in an occluded state.

In another embodiment, as shown in FIGS. 9A and 9B, the closure mechanism 950 comprises a first closure element 960 that includes a first interlocking profile 970 that extends from a first base 975 and a second closure element 980 that includes a complementary second interlocking profile 990 that extends from a second base 995. The first closure element 960 and second closure element 980 are elongate and extend along the opening 13 of the pouch 10 shown in FIG. 1. FIG. 9A depicts the first and second closure elements 960, 980 in a non-occluded state, while FIG. 9B shows the first and second closure elements in an occluded state. In this embodiment, the first closure element 960 is attached to the inner surface 17 of the second sidewall 12, and the second closure element 980 is attached to the inner surface 15 of the first sidewall 11. The second interlocking profile 990 is a female profile that includes first and second legs 1000, 1010, each with a respective distal surface 1020, 1030.

A sealing flange 1040 is disposed over and in contact with each of the first and second legs 1000, 1010. The sealing flange 1040 is attached to the second base 995, for example, by a thermoplastic weld layer 1080, at a first end 1050 of the sealing flange and also at a second end 1060 of the sealing flange. When the first and second closure elements 960, 980 are occluded, as shown in FIG. 9B, the first interlocking profile 970 interlocks with the second interlocking profile 990. A distal surface 1055 of the first interlocking profile 970 presses into the sealing flange 1040. The sealing flange 1040 is wrapped around the distal surface 1055 of the first interlocking profile 970 and engages lateral surfaces 1060, 1070 of the first interlocking profile and the distal surfaces 1020, 1030 of the respective first and second legs 1000, 1010 to form a seal between the sealing flange and the first and second interlocking profiles.

The first interlocking profile 970 may be integral with the first base 975 and the second interlocking profile 990 may be integral with the second base 995. The second interlocking profile 990 and the sealing flange 1040 may each be independent attach to the second base 995.

Figure 10A:
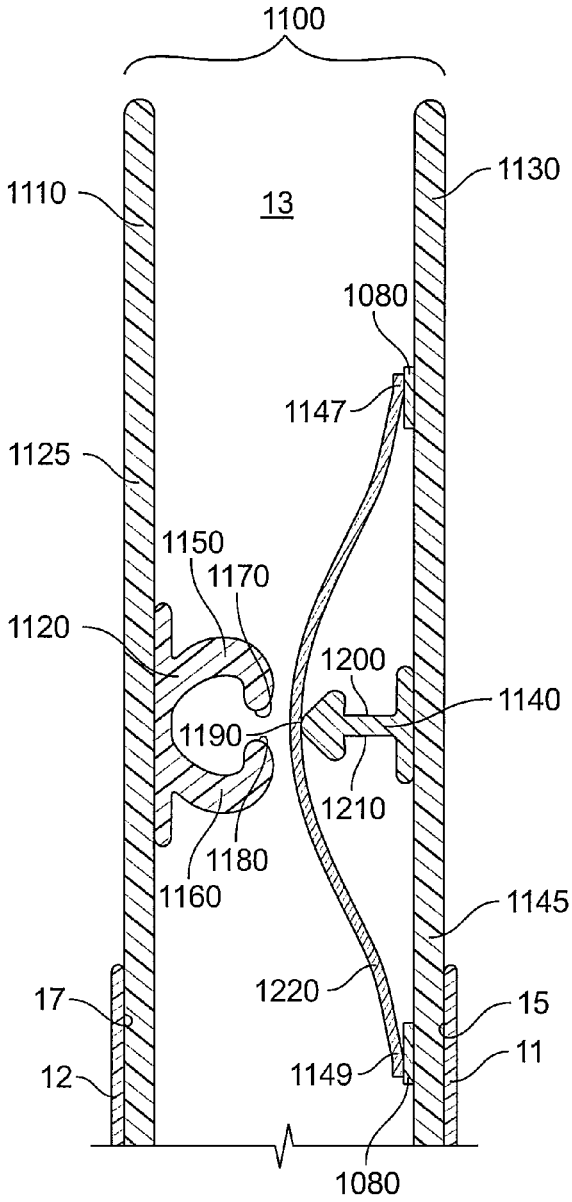
FIG. 10A is a partial cross-sectional view of another embodiment, taken generally along the lines 2-2 of FIG. 1.
Figure 10B:
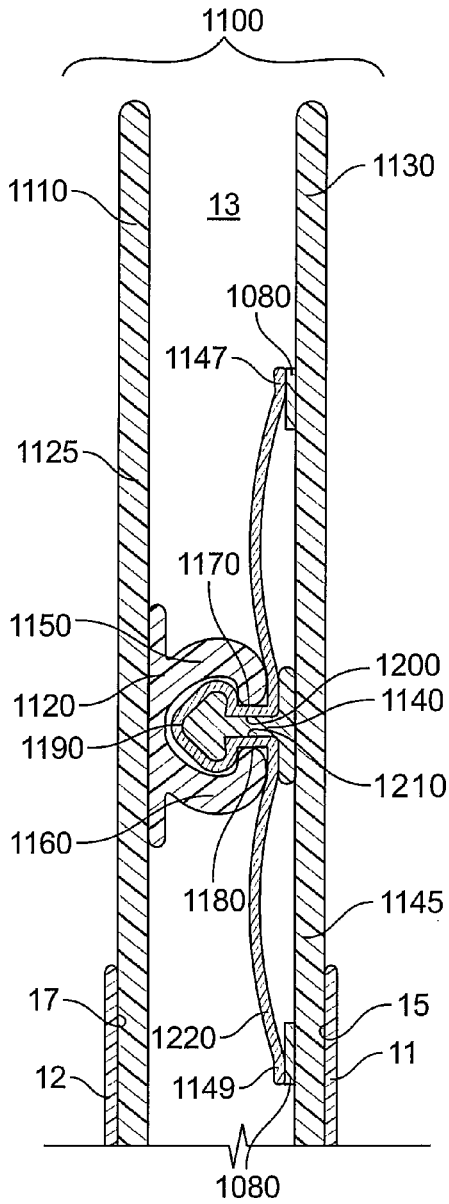
FIG. 10B is a partial cross-sectional view of the embodiment depicted in FIG. 10A in an occluded state.

Another embodiment, shown in FIGS. 10A and 10B, is similar to the embodiment discussed with regard to FIGS. 9A and 9B, except for the following differences. The closure mechanism 1100 comprises a first closure element 1110 that includes a first interlocking profile 1120 that extends from a first base 1125 and a second closure element 1130 that includes a complementary second interlocking profile 1140 that extends from a second base 1145. FIG. 10A depicts the first and second closure elements 1110, 1130 in a non-occluded state, while FIG. 10B shows the first and second closure elements in an occluded state. In this embodiment, first interlocking profile 112 is a female profile that includes first and second legs 1150, 1160, each with a respective distal surface 1170, 1180. The second interlocking profile 1140 is a male profile that has a distal surface 1190 and lateral surfaces 1200, 1210.

A sealing flange 1220 is disposed over and in contact with the distal surface 1190 of the second interlocking profile 1140. The sealing flange 1220 is attached to the second base 1145 at a first end 1147 of the sealing flange and also at a second end 1149 of the sealing flange. When the first interlocking profile 1120 interlocks with the second interlocking profile 1140, the distal surface 1190 of the second interlocking profile 1140 presses into the sealing flange 1220. The sealing flange 1220 is wrapped around the distal surface 1190 of the second interlocking profile 1140 and engages the lateral surfaces 1200, 1210 of the second interlocking profile and the distal surfaces 1170, 1180 of the respective first and second legs 1150, 1160, to form a seal between the sealing flange and the first and second interlocking profiles 1120, 1140.

Figure 11A:
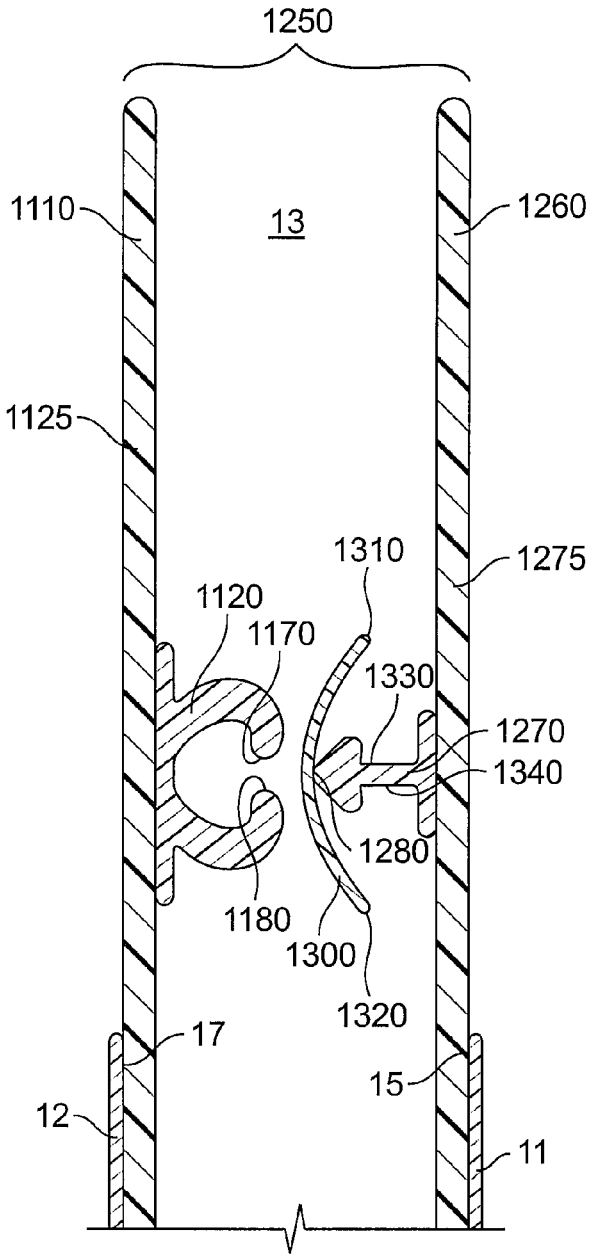
FIG. 11A is a partial cross-sectional view of yet another embodiment, taken generally along the lines 2-2 of FIG. 1.
Figure 11B:
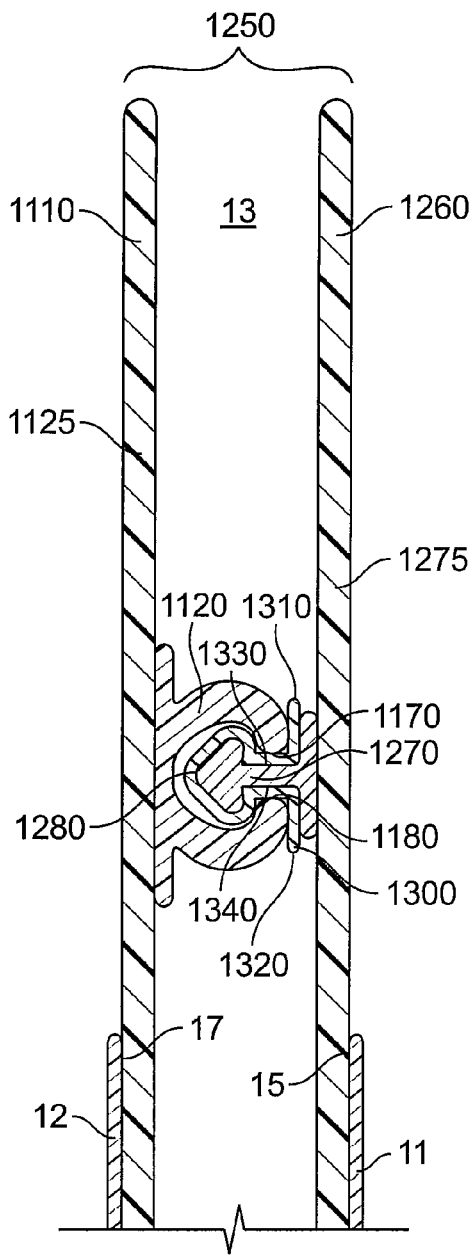
FIG. 11B is a partial cross-sectional view of the embodiment depicted in FIG. 11A in an occluded state.

Yet another embodiment, shown in FIGS. 11A and 11B, is similar to the embodiment discussed with regard to FIGS. 10A and 10B, except for the following differences. The closure mechanism 1250 comprises the first closure element 1110 that includes the first interlocking profile 1120 that extends from the first base 1125 and a second closure element 1260 that includes a complementary second interlocking profile 1270 that extends from a second base 1275. FIG. 11A depicts the first and second closure elements 1110, 1260 in a non-occluded state, while FIG. 11B shows the first and second closure elements in an occluded state. In this embodiment, a sealing flange 1300 is attached to the distal surface 1280 of the second interlocking profile 1270. The sealing flange 1300 is not attached at a first end 1310 or at a second end 1320 to the second base 1275. When the first interlocking profile 1120 interlocks with the second interlocking profile 1270, the distal surface 1280 of the second interlocking profile 1270 presses into the sealing flange 1300. The sealing flange 1300 is wrapped around the distal surface 1280 of the second interlocking profile 1270 and engages lateral surfaces 1330, 1340 of the second interlocking profile and the distal surfaces 1170, 1180 of the respective first and second legs 1150, 1160 to form a seal between the sealing flange and the first and second interlocking profiles 1120, 1270.

Figure 12A:
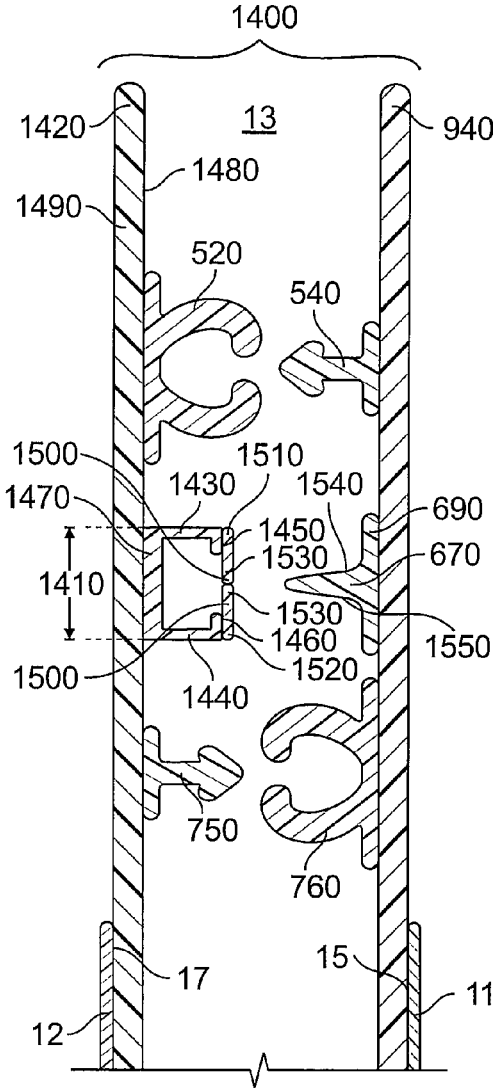
FIG. 12A is a partial cross-sectional view of a still further embodiment, taken generally along the lines 2-2 of FIG. 1.
Figure 12B:
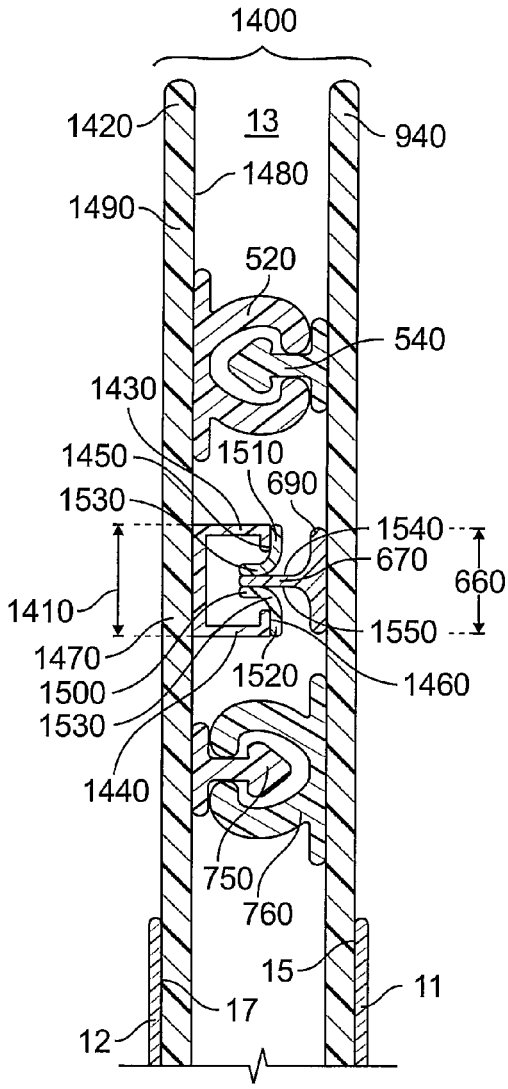
FIG. 12B is a partial cross-sectional view of the embodiment depicted in FIG. 12A in an occluded state.

A still further embodiment, shown in FIGS. 12A and 12B, is similar to the embodiment discussed with regard to FIG. 8, except for the following differences. In this embodiment, a closure mechanism 1400 includes a first sealing section 1410 disposed on a first closure element 1420 between the first and third interlocking profiles 520, 750. The first sealing section 1410 includes first and second protuberances 1430 and 1440, respectively, having first and second distal surfaces 1450 and 1460, and each integral with and extending from a first flange

1470. The first flange 1470 may be integral with or otherwise attached to an inner surface 1480 of a first base 1490 of the first closure element 1410.

A sealing flange 1500 is disposed over and in contact with each of the distal surfaces 1450 and 1460. The sealing flange 1500 is attached to the first distal surface 1450 at a first end 1510 of the sealing flange and to the second distal surface 1460 at a second end 1520 of the sealing flange. The sealing flange 1500 may be made of a thermoplastic film independent of the sidewalls 11, 12, such as, for example, an elastomer or a polyolefin plastomer, such as AFFINITY™ resin. The sealing flange 1500 also includes a slit along a length thereof to form film flaps 1530 to allow penetration of the sealing member 670 into a space between the first and second protuberances 1430 and 1440, when the first closure element 1420 and the second closure element 940 are occluded. In the occluded state shown in FIG. 12B, the film flaps 1530 are urged against lateral surfaces 1540, 1550 of the sealing member 670 to form a seal between each film flap and each lateral surface.

Figure 13A:
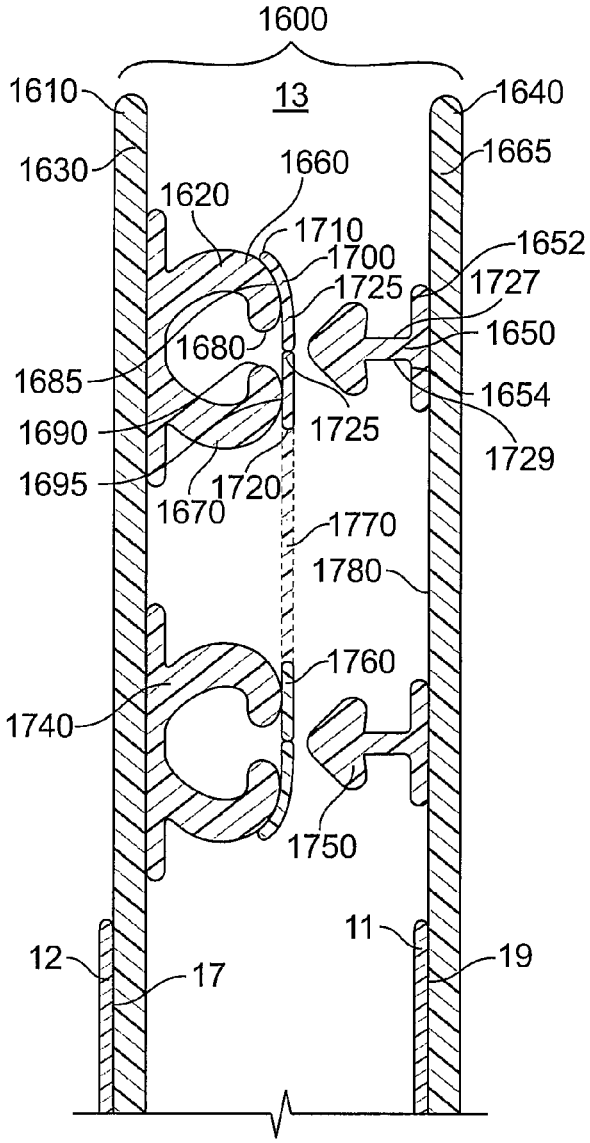
FIG. 13A is a partial cross-sectional view of yet a further embodiment, taken generally along the lines 2-2 of FIG. 1.
Figure 13B:
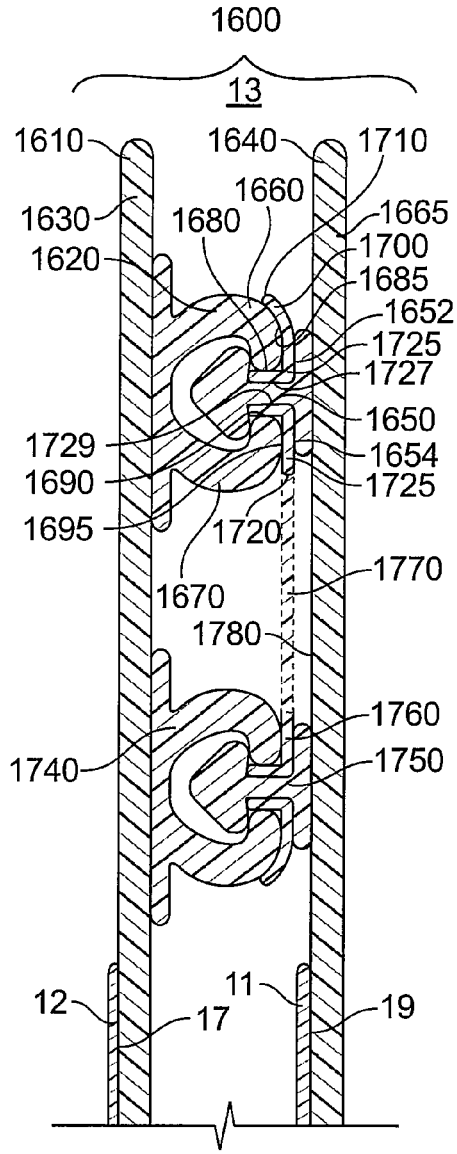
FIG. 13B is a partial cross-sectional view of the embodiment depicted in FIG. 13A in an occluded state.

In yet a further embodiment, shown in FIGS. 13A and 13B, a closure mechanism 1600 includes a first closure element 1610 that includes a first interlocking profile 1620 that extends from a first base 1630 and a second closure element 1640 that includes a complementary second interlocking profile 1650 that extends from a second base 1665. The second interlocking profile includes first and second shoulder surfaces 1652, 1654 that face away from the second base 1640. The first closure element 1610 and second closure element 1640 are elongate and extend along the opening 13 of the pouch 10 shown in FIG. 1. FIG. 13A depicts the first and second closure elements 1610, 1640 in a non-occluded state, while FIG. 13B shows the first and second closure elements in an occluded state. In this embodiment, the first closure element 1610 is attached to the inner surface 17 of the second sidewall 12, and the second closure element 1640 is attached to the outer surface 19 of the first sidewall 11. The first interlocking profile 1620 is a female profile that includes first and second legs 1660, 1670. The leg 1660 includes a distal surface 1680 and a first surface 1685 furthermost from the first base 1630. The leg 1670 includes a distal surface 1690 and a second surface 1695 furthermost from the first base 1630.

A first sealing flange 1700 is disposed over and in contact with each of the first and second surfaces 1685, 1695 furthermost from the base 1630. The first sealing flange 1700 is attached to the first leg 1600 proximate to a first end 1710 of the first sealing flange and to the second leg 1670 proximate to a second end 1720 of the first sealing flange. The first sealing flange 1700 also includes a slit along a length thereof to form film flaps 1725. Each of the film flaps 1725 has a free end that is movable to allow penetration of the second interlocking profile 1650 into the first interlocking profile 1620 between the first and second legs 1660, 1670, when the first closure element 1610 and the second closure element 1640 are occluded. In the occluded state, shown in FIG. 13B, the film flaps 1725 form gastight seals between the first and second surfaces 1685, 1695 furthermost from the base 1630 and the respective first and second shoulder surfaces 1652, 1654 of the second interlocking profile 1650. The film flaps 1725 may also form gastight seals between lateral surfaces 1727, 1729 of the second interlocking profile 1650 and the distal surfaces 1680, 1690 of the respective first and second legs 1660, 1670.

Further, the movable free ends of the film flaps 1725 may provide a further seal in the presence of gas flow or a pressure difference, for example, across the first and second legs of the first interlocking profile 1620, because each of the free ends of the film flaps 1725 is movable in response to such a gas flow or pressure difference. Illustratively, consider application of the closure mechanism 1600 to the pouch 10 shown in FIG. 1, and evacuation of the pouch through the valve 6. As the first and second interlocking profiles 1620, 1650 are brought together just prior to occlusion thereof, a decrease in pressure from a user side to a product side thereof may result. The free end of the film flap 1725 attached to the surface 1685 may respond to this pressure decrease and be forced downwardly. Subsequent to occlusion of the first and second interlocking profiles 1620, 1650, and further evacuation of the pouch interior 7, the pressure difference may force the free end of the film flap 1725 between the first and second legs 1660, 1670 of the first interlocking profile 1620, and may thus further seal the first and second interlocking profiles 1620, 1650.

A second set of complementary interlocking profiles may be added to the embodiment shown in FIGS. 13A and 13B. A third interlocking profile 1740 may be disposed adjacent to the first interlocking profile 1620 on the first closure element 1610 and a fourth interlocking profile 1750 may be disposed adjacent to the second interlocking profile 1650 on the second closure element 1640. The profile of the third and fourth interlocking profiles 1740, 1750 that is female also includes a second sealing flange 1760 that may be similar in structure and function to the first sealing flange 1700 applied to the first interlocking profile 1620. The addition of a second set of complementary interlocking profiles 1740, 1750 may add strength to the closure mechanism 1600 to provide increased resistance to opening forces and facilitate a better seal between the interlocking profiles. In a further embodiment, the first and second sealing flanges 1700, 1760 are part of a unitary sealing flange 1770, as shown by dashed lines in FIGS. 13A and 13B.

Figure 13C:
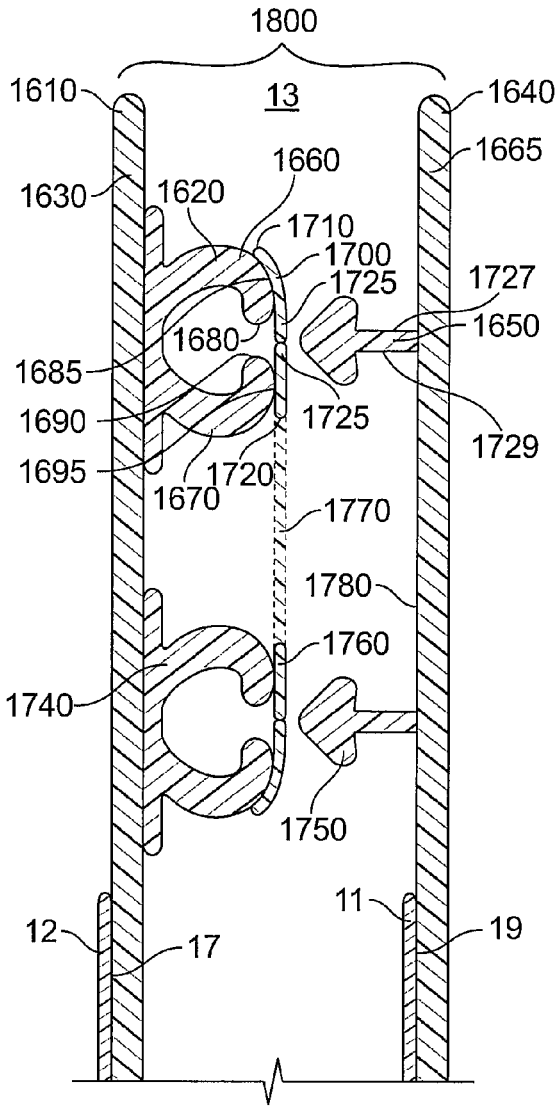
FIG. 13C is a partial cross-sectional view of a still further embodiment, taken generally along the lines 2-2 of FIG. 1.
Figure 13D:
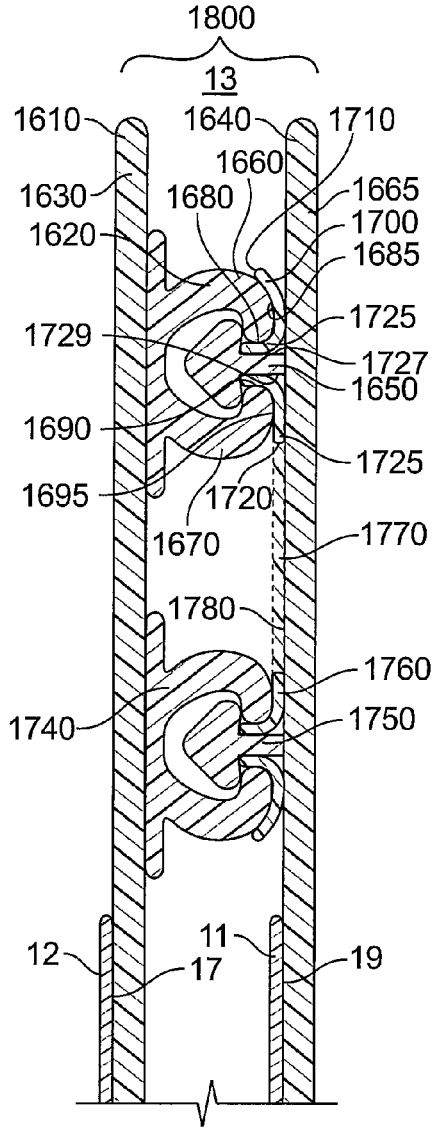
FIG. 13D is a partial cross-sectional view of the embodiment depicted in FIG. 13C in an occluded state.

It is contemplated that, in a further embodiment, the first and second shoulder surfaces 1652, 1654 of the second interlocking profile 1650 may be reduced or omitted, as shown, for a closure mechanism 1800 in FIGS. 13C and 13D. Similar to the embodiment shown in FIG. 13B, the film flaps 1725 shown in FIG. 13D form gastight seals between lateral surfaces 1727, 1729 of the second interlocking profile 1650 and the distal surfaces 1680, 1690 of the respective first and second legs 1660, 1670. However, in this embodiment, the film flaps 1725 also form gastight seals between the first and second surfaces 1685, 1695 furthermost from the base 1630 and inner surface 1780 of the second closure element 1640 on each side of the second interlocking profile 1650. Further, the unitary sealing flange 1770 in FIG. 13D may lay flat against the surface 1780 to form an additional gastight seal therebetween. Although not shown, an elastomer or a polyolefin layer, for example, may also be applied to the surface 1780 between the second and fourth interlocking profiles 1650, 1750 to improve the integrity of the gastight seal between the surface 1780 and the unitary sealing flange 1770.

Each of the second and fourth interlocking profiles 1650, 1750 may be adjusted in size, for example, to lengthen or to shorten the extent of the lateral surfaces 1727 and 1729, or to increase or to decrease a distance between the lateral surfaces 1727 and 1729. Each of these adjustments may tighten or loosen fit tolerances between the first and third 1620, 1704 and the second and fourth interlocking profiles 1650, 1750, respectively. Tightening the first tolerances may increase the force required by a user to occlude the first and second closure elements 1610, 1640, whereas loosening the fit tolerances may decrease the force required. Further, the compressibility and thickness of the sealing flange 1700 are factors that may affect the force required. Increased compressibility may compensate for increased thickness in the sense that a more compressible, or softer, material may allow for a thicker sealing flange 1700, without an increase in closing force. The sealing flange 1700 may be made of a low cost extrudable material independent of the sidewalls 11, 12, such as, for example, a compressible elastomer, such as silicone rubger, or a polyolefin plastomer, such as an AFFINITY™ resin. Illustratively, the sealing flange 1700 may range in thickness from about 0.0005 inches to about 0.01 inches. The composition and/or thickness of the sealing flange 1700 may be adjusted to achieve a desired closing force while maintaining a gastight seal between the first and second closure elements 1610, 1640.

Figure 14A:
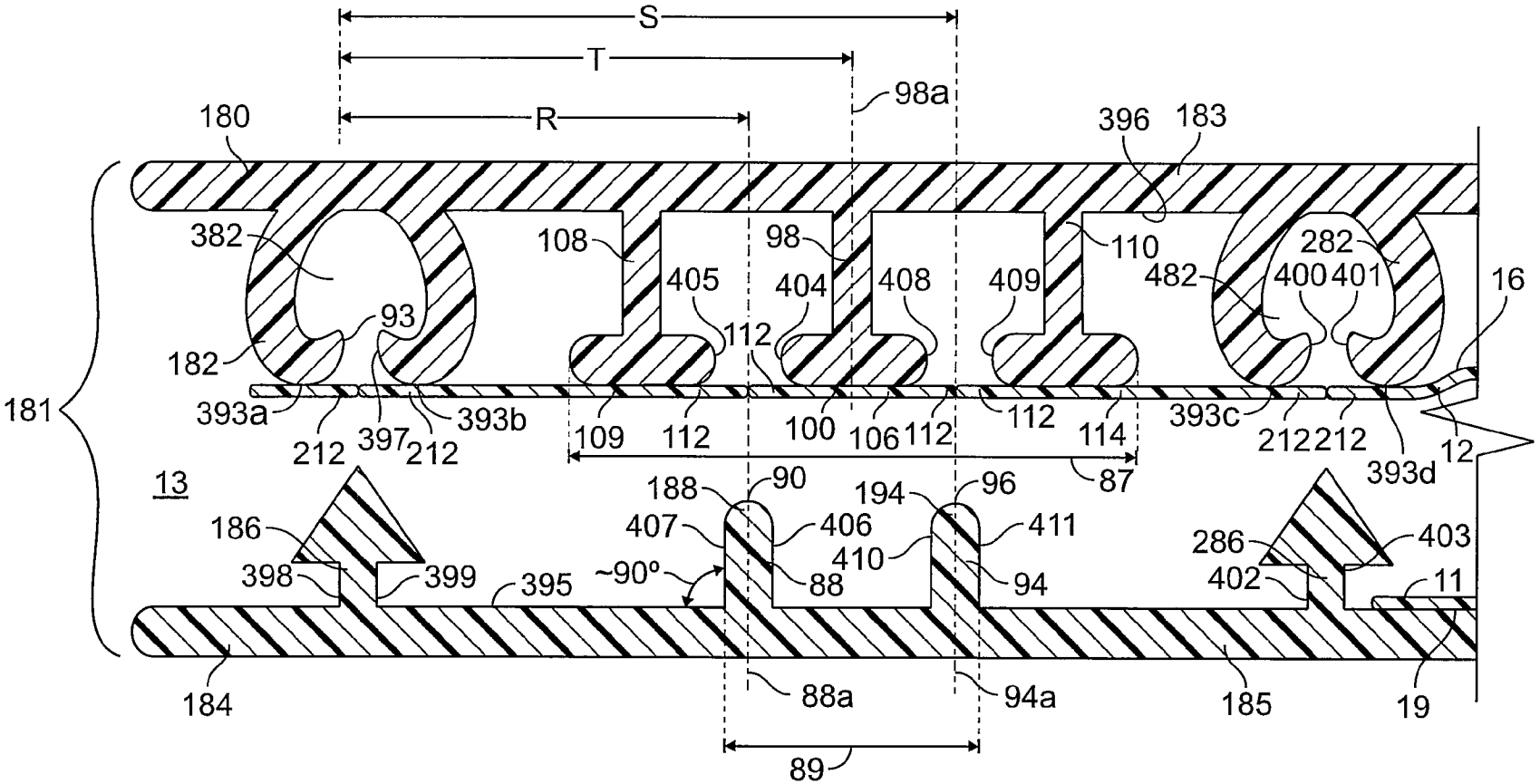
FIG. 14A is a partial cross-sectional view of another embodiment in a non-occluded state, taken generally along the lines 2-2 of FIG. 1.
Figure 14B:
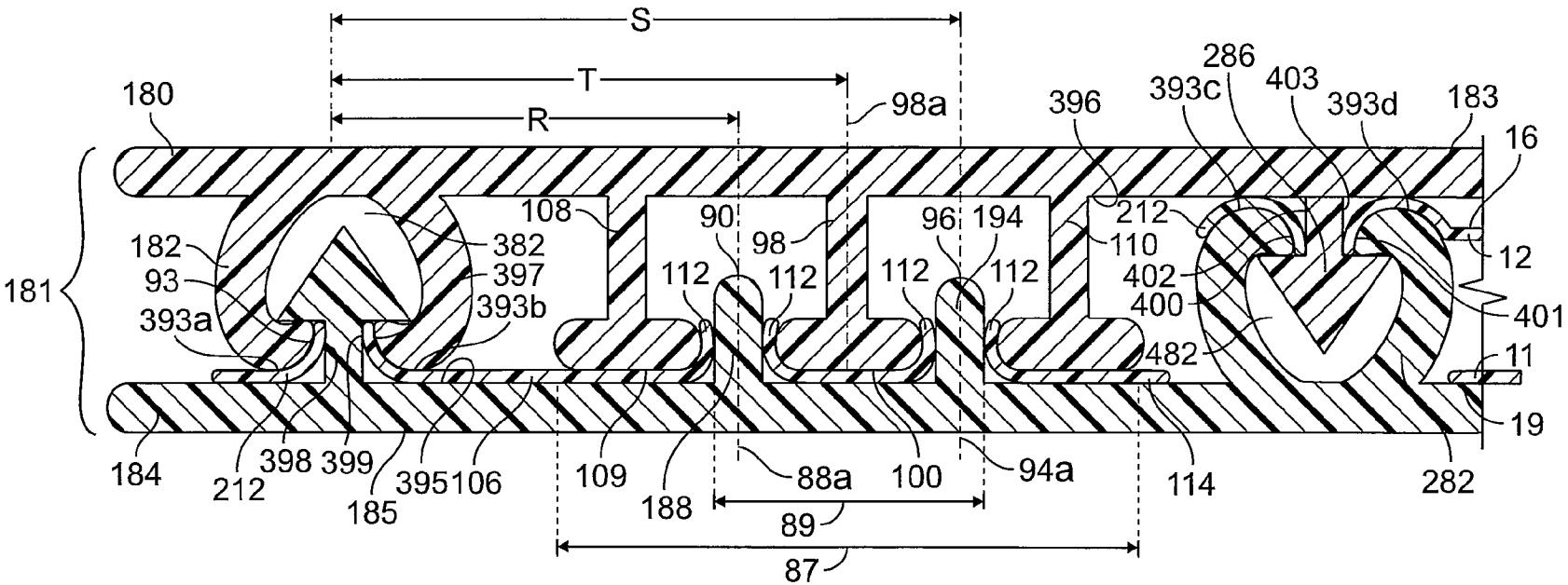
FIG. 14B is a partial cross-sectional view of the embodiment depicted in FIG. 14A in an occluded state.

Referring to FIGS. 14A and 14B, a closure mechanism 181 includes a first closure element 180 that has a first interlocking profile 182 and a second closure element 184 that includes a complementary second interlocking profile 186. FIG. 14A depicts the first and second closure elements 180, 184 in a non-occluded state, while FIG. 14B depicts the first and second closure elements 180, 184 in an occluded state. In this embodiment, the first closure element 180 is attached to the outer surface 16 of the second sidewall 12, and the second closure element 184 is attached to an outer surface 19 of the first sidewall 11.

A first sealing section 87 is similar to the first sealing section 87 discussed above with regard to FIG. 4. A second sealing section 89 is also similar to the second sealing section 89 discussed above with regard to FIG. 4. Referring to FIG. 14A, the first closure element 180 includes a third interlocking profile 282 on a product side of the first sealing section 87, and the second closure element 184 includes a complementary fourth interlocking profile 286 on the product side of the second sealing section 89. In FIG. 14BG, the third and fourth interlocking profiles 282 and 286 have had their positions on the first and second closure elements 180, 184 switched as an example of a possible variation. In another embodiment, the third and fourth interlocking profiles 282, 286 may be disposed on an opening side of the first and second interlocking profiles 182, 186, respectively. In yet another embodiment, the first and second interlocking profiles 182, 186 may be disposed on a product side of the third and fourth interlocking profiles 282, 286, respectively.

The sealing flange 106 is attached respectively to the distal surfaces 100, 109, 114 of the first, second, and third protuberances, 98, 108, 110, respectively. In this embodiment, the sealing flange 106 is also attached to innermost surfaces 393*a* and 393*b* of the first interlocking profile 182 and innermost surfaces 393*c* and 393*d* of the third interlocking profile 282. The sealing flange 106 includes slits along a length thereof to form film flaps 112 to allow penetration of the first and second sealing members 88, 94 into spaces between the first protuberance 98 and the second protuberance 108 and the first protuberance 98 and the third protuberance 110, respectively, when the first closure element 80 and the second closure element 84 are occluded. The sealing flange 106 is also slit along a length thereof to form film flaps 212 to allow penetration of the second and fourth interlocking profiles 186 and 286 into channels 382 and 482, respectively, within the first and third interlocking profiles 182 and 282 when the first closure element 180 and the second closure element 184 are occluded.

In this embodiment, the sealing flange 106 is illustrated as a unitary, multiply slit piece of thermoplastic material in FIG. 14A, but may also comprise several individual flanges, each made of the same or different materials and spanning a single gap between the distal or innermost surfaces 100 and 109, 100 and 114, 393*a* and 393*b*, and 393*c* and 393*d*, or any combination of flanges spanning the single gaps or multiple gaps. For example, FIG. 14B depicts the sealing flange 106 as a film independent of the sidewalls 11, 12, which may, for example, be made of a low cost extrudable material, such as a compressible elastomer or a polyolefin plastomer. Similar to the embodiment discussed in regard to FIGS. 13C and 13D, the sealing flange 106 may form a seal between each of the innermost surfaces 393*a* and 393*b* and an inner surface 395 of the second closure element 184, as well as between distal ends 93, 397 of the first interlocking profile 182 and respective lateral surfaces 398, 399 of the second interlocking profile 186. The sealing flange 106 may also form a seal between each of the innermost surfaces 393*c* and 393*d* and an inner surface 396 of the first closure element 180, as well as between distal ends 400, 401 of the third interlocking profile 182 and respective lateral surfaces 402, 403 of the fourth interlocking profile 286. In addition, the sealing flange 106 may also form a seal against the surface 395 in regions between the first sealing section 87 and each of the first and third closure profiles 182, 282. Further, in this embodiment, each of the distal ends 100, 109, and 114 of the first, second and third protuberances, respectively, engages the sealing flange 106 against the surface 395 to form additional gastight seals between the surface 395 and each of the distal ends 100, 109, and 114. Still further, the film flaps 112 may also form gastight seals between lateral edges 404, 405 of the first and second protuberances 98, 108, respectively, and respective lateral edges 406, 407 of the fourth protuberance 188, as well as between lateral edges 408, 409 of the first and third protuberances 98 and 110, respectively, and respective lateral edges 410, 411 of the fifth protuberance 194.

Although the present disclosure has been described relative to specific exemplary embodiments thereof, it will be understood by those skilled in the art that modifications can be made thereto without departing from the scope and spirit of the disclosure.

INDUSTRIAL APPLICATION

A closure mechanism that includes first and second closure elements is presented that may be used to pack and to store perishable items in a vacuum environment. Each of the first and second closure elements interlocks and forms a seal with the other of the first and second closure elements. A sealing flange is attached across a sealing section and/or a closure profile of one of the first and second closure elements. When the first and second closure elements are occluded, a sealing member and/or a complementary closure profile is urged against the sealing flange and forms a seal therebetween. The closure mechanism may be used to seal a storage pouch to keep food or other perishable contents stored inside the pouch fresh for an extended period of time.

Numerous modifications to the present disclosure will be apparent to those skilled in the art in view of the foregoing description. Accordingly, this description is to be construed as illustrative only and is presented for the purpose of enabling those skilled in the art to make and to use the invention, and to teach the best mode of carrying out the same. The exclusive rights to all modifications that come within the scope of the appended claims are reserved. All patents, patent publications and applications, and other references cited herein are incorporated by reference herein in their entirety.

The invention claimed is:

1. A closure mechanism for a reclosable pouch, the closure mechanism comprising:

a female profile having first, second, and third legs extending from a base of a first closure element;

a first sealing flange attached to each of the first and second legs, with a slit disposed through the first sealing flange to define a first sealing flap that depends from the first leg and a second sealing flap that depends from the second leg;

a second sealing flange attached to each of the second and third legs, with a slit disposed through the second sealing flange to define a third sealing flap that depends from the second leg and a fourth sealing flap that depends from the third leg;

a first male profile extending from a base of a second closure element, the first male profile adapted to engage a portion of the first and second sealing flaps to form a seal therebetween when the male and female profiles are occluded; and a second male profile extending from the base of the second closure element, the second male profile adapted to engage a portion of the third and fourth sealing flaps to form a seal therebetween when the male and female profiles are occluded.

2. The closure mechanism of claim 1, wherein a portion of the first sealing flap is engaged between a distal surface of the first leg and a first lateral surface of the first male profile and a portion of the second sealing flap is engaged between a distal surface of the second leg and a second lateral surface of the first male profile when the first male profile and the female profile are occluded.

3. The closure mechanism of claim 1, wherein a portion of the third sealing flap is engaged between a distal surface of the second leg and a first lateral surface of the second male profile and a portion of the fourth sealing flap is engaged between a distal surface of the third leg and a second lateral surface of the second male profile when the second male and the female profile are occluded.

4. The closure mechanism of claim 3, wherein a unitary sealing flange includes the first, second, third, and fourth sealing flanges, and the unitary sealing flange is formed from a single continuous piece of thermoplastic film.

5. The closure mechanism of claim 4, further comprising:

a second female profile extending from the base of the first closure element, and a third male profile extending from the base of the second closure element, the third male profile adapted to engage the second female profile.

6. The closure mechanism of claim 1, wherein the first male profile and the surface of the second base of the second closure element form at least one of a gastight seal and a watertight seal with respective sealing flaps.

7. A closure mechanism for a reclosable pouch, the closure mechanism comprising:

(a) a first set of complementary closure profiles including:

(i) a female profile having first and second legs extending from a base of a first closure element;

(ii) a sealing flange attached to each of the first and second legs and having a slit disposed therethrough to define a first sealing flap that depends from the first leg and a second sealing flap that depends from the second leg; and (iii) a male profile extending from a base of a second closure element, the male profile adapted to engage a portion of at least one of the first and second sealing flaps to form a seal therebetween when the respective male and female profiles are occluded;

(b) a second set of complementary closure profiles including:

(i) a female profile having first and second legs extending from a base of one of the first and second closure elements;

(ii) a sealing flange attached to each of the first and second legs of the female profile of the second set of complementary closure profiles, and having a slit disposed therethrough to define a first sealing flap that depends from the first leg and a second sealing flap that depends from the second leg; and (iii) a male profile extending from a base of the other of the first and second closure elements, the male profile adapted to engage at least one of the first and second sealing flaps of the sealing flange of the second set of complementary closure profiles to form a seal therebetween when the respective male and the female profiles are occluded;

(c) a first sealing section extending from the first closure element, the first sealing section including (i) a first protuberance having a distal surface, (ii) a second protuberance having a distal surface, and (iii) a sealing flange attached to the first closure element at opposite ends of the sealing flange and extending between the distal surfaces of the first and second protuberances; and (d) a second sealing section extending from the second closure element and including a sealing member having a distal surface, such that the distal surface of the second sealing section is disposed between the distal surfaces of the first and second protuberances of the first sealing section, and such that the sealing member urges against the sealing flange of the first sealing section to form a seal therebetween when the respective male and female profiles of the first set of complementary closure profiles are occluded.

8. The closure mechanism of claim 7, wherein the sealing flange of the first sealing section comprises a slit disposed therethrough to allow the distal surface of the sealing member of the second sealing section to penetrate through the sealing flange of the first sealing section, to form a seal between the sealing member of the second sealing section and the first sealing section when the respective male and female profiles of the first set of complementary closure profiles are occluded.

9. The closure mechanism of claim 8, wherein the sealing flange of the first sealing section is attached proximate to a first end thereof to the distal surface of the first protuberance and proximate to a second end thereof to the distal surface of the second protuberance.

10. The closure mechanism of claim 7, wherein the sealing flange of the first sealing section is attached proximate to a first end thereof to the distal surface of the first protuberance and proximate to a second end thereof to the distal surface of the second protuberance.

11. The closure mechanism of claim 7, wherein the sealing flange of the first sealing section is attached proximate to a first end thereof to a base on a first side of the first and second protuberances and proximate to a second end thereof to the base on a second side of the first and second protuberances.

12. The closure mechanism of claim 7, wherein the first and second sealing sections are disposed between the first and second sets of complementary closure profiles.

13. The closure mechanism of claim 7, wherein the first and second sealing sections are disposed on a product side of the first and second sets of complementary closure profiles.

* * * * *